US007944425B2

(12) United States Patent
Watanuki et al.

(10) Patent No.: US 7,944,425 B2
(45) Date of Patent: May 17, 2011

(54) LIQUID CRYSTAL DISPLAY ELEMENT AND METHOD OF DRIVING THE ELEMENT

(75) Inventors: Tsuneo Watanuki, Kawasaki (JP); Makoto Fukuda, Kawasaki (JP); Fumio Yamagishi, Ebina (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/783,636

(22) Filed: May 20, 2010

(65) Prior Publication Data

US 2010/0253714 A1 Oct. 7, 2010

Related U.S. Application Data

(63) Continuation of application No. PCT/JP2007/072567, filed on Nov. 21, 2007.

(51) Int. Cl.
*G09G 3/36* (2006.01)

(52) U.S. Cl. ..... 345/94; 345/95; 345/97

(58) Field of Classification Search ..... 345/87–104, 345/107, 204–215, 690–697; 359/296
See application file for complete search history.

(56) References Cited

U.S. PATENT DOCUMENTS

| | | | | |
|---|---|---|---|---|
| 6,154,190 | A * | 11/2000 | Yang et al. | 345/94 |
| 6,268,840 | B1 * | 7/2001 | Huang | 345/94 |
| 6,950,086 | B2 * | 9/2005 | Nagai et al. | 345/95 |
| 7,119,772 | B2 * | 10/2006 | Amundson et al. | 345/87 |
| 7,528,822 | B2 * | 5/2009 | Amundson et al. | 345/107 |
| 2002/0036614 | A1 * | 3/2002 | Nagai et al. | 345/95 |
| 2002/0057239 | A1 * | 5/2002 | Hiji et al. | 345/87 |
| 2002/0080102 | A1 * | 6/2002 | Asao et al. | 345/87 |
| 2003/0006950 | A1 * | 1/2003 | Saishu et al. | 345/87 |
| 2003/0122758 | A1 * | 7/2003 | Lee et al. | 345/89 |

(Continued)

FOREIGN PATENT DOCUMENTS

| | | | |
|---|---|---|---|
| JP | 2002-014325 | A | 1/2002 |
| JP | 2004-004200 | A | 1/2004 |
| JP | 2004-219715 | A | 8/2004 |
| JP | 2005-242210 | A | 9/2005 |
| JP | 2006-023481 | A | 1/2006 |

OTHER PUBLICATIONS

International Search Report of PCT/JP2007/072567, mailing date of Feb. 5, 2008.

*Primary Examiner* — Amare Mengistu
*Assistant Examiner* — Dmitriy Bolotin
(74) *Attorney, Agent, or Firm* — Westerman, Hattori, Daniels & Adrian, LLP

(57) ABSTRACT

The invention relates to a liquid crystal display element displaying an image using a liquid crystal layer having memory characteristics and a method of driving the element. A liquid crystal display element capable of suppressing the generation of an afterimage attributable to image sticking is provided along with a method of driving the same. The liquid crystal display element includes a display section having memory characteristics including a cholesteric liquid crystal layer and displaying an image when a voltage is applied to the cholesteric liquid crystal layer, the section being capable of keeping the image displayed without electric power, a driving condition storing section for storing a plurality of different driving conditions including a voltage and an application period of the voltage, and a control section determining a display period for which a presently displayed image has been displayed on the display section when the displayed image is rewritten into a new image, acquiring a driving condition according to the display period from the driving condition storing section, and causing the display section to display the new image based on the acquired driving condition.

19 Claims, 13 Drawing Sheets

U.S. PATENT DOCUMENTS

2004/0105614 A1* 6/2004 Kobayashi et al. ..... 385/16
2005/0001812 A1* 1/2005 Amundson et al. ..... 345/107
2005/0024353 A1* 2/2005 Amundson et al. ..... 345/204
2006/0012554 A1* 1/2006 Saishu et al. ..... 345/97
2006/0152438 A1* 7/2006 Tanaka ..... 345/48
2006/0232531 A1* 10/2006 Amundson et al. ..... 345/87
2007/0018921 A1* 1/2007 Yoshihara et al. ..... 345/88
2007/0268416 A1* 11/2007 Harada et al. ..... 349/2
2010/0149209 A1* 6/2010 Nose ..... 345/618
2010/0156967 A1* 6/2010 Watanuki et al. ..... 345/691

* cited by examiner

START
S1
$T_a \geqq A_1$
YES
NO
S10
RESET DRIVING CONDITION D (D=2)
S2
D=1
NO
YES
S5
$T_a \geqq C_1$
YES
NO
S6
CALCULATE CUMULATIVE PERIOD $T_b$ ($T_b=T_b+T_a$)
S7
$T_b \geqq B$
YES
NO
S8
RESET DRIVING CONDITION D (D=1)
S9
RESET PERIOD $T_b$ ($T_b=0$)
RESET PERIOD $T_a$ ($T_a=0$) START MEASURING PERIOD $T_a$
S3
EXECUTE DISPLAY REWRITE
S4
END START
S11
$T_a \geqq A_1$
YES
NO
S12
D=1
NO
YES
S15
$T_a \geqq C_1$
YES
NO
S16
CALCULATE CUMULATIVE PERIOD $T_b$ ($T_b=T_b+T_a$)
S17
$T_b \geqq B$
YES
NO
S18
RESET DRIVING CONDITION D (D=1)
RESET DRIVING CONDITION D (D=2)
S20
S21
$T_a > B_1$
YES
NO
S23
$B=B_1$
$B=T_a$
S22
RESET PERIOD $T_b$ ($T_b=0$)
S19
RESET PERIOD $T_a$ ($T_a=0$)
START MEASURING PERIOD $T_a$
S13
EXECUTE DISPLAY REWRITE
S1
END START
S31
$T_a \geqq A_1$
YES
NO
S32
D=1
NO
YES
S35
$T_a \geqq C_1$
YES
NO
S36
CALCULATE CUMULATIVE PERIOD $T_b$ ($T_b=T_b+T_a$)
S37
$T_b \geqq B$
YES
NO
S38
RESET DRIVING CONDITION D (D=1)
S40
$T_a \geqq A_2$
YES
NO
S41
$B=B_1$
S43
$B=B_2$
RESET DRIVING CONDITION D (D=2)
S42
RESET PERIOD $T_b$ ($T_b=0$)
S39
RESET PERIOD $T_a$ ($T_a=0$) START MEASURING PERIOD $T_a$
S33
EXECUTE DISPLAY REWRITE
S34
END

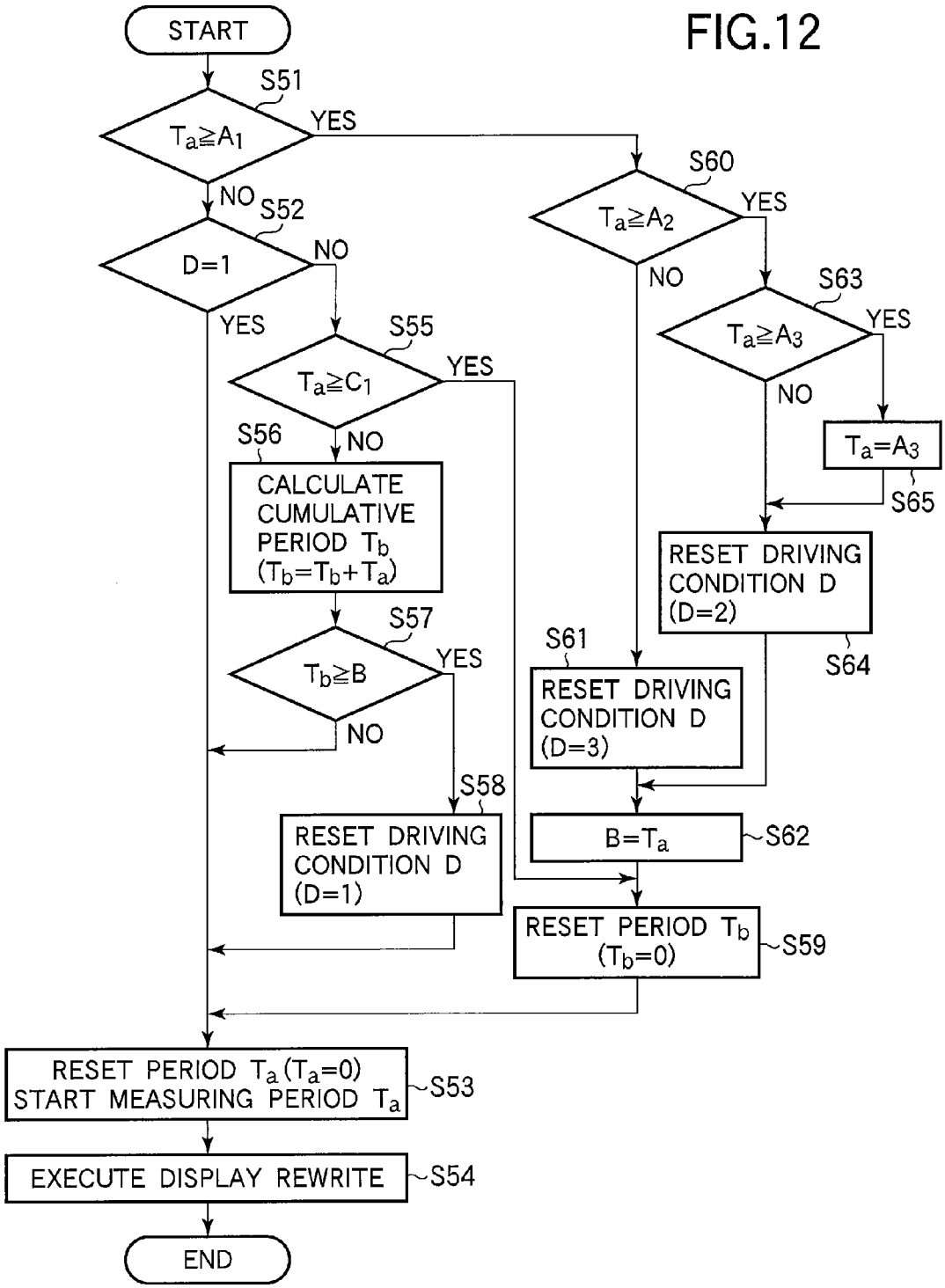
FIG.12
START
S51
$T_a \geqq A_1$
YES
NO
S52
D=1
NO
YES
S55
$T_a \geqq C_1$
YES
NO
S56
CALCULATE CUMULATIVE PERIOD $T_b$ ($T_b=T_b+T_a$)
S57
$T_b \geqq B$
YES
NO
S58
RESET DRIVING CONDITION D (D=1)
S60
$T_a \geqq A_2$
YES
NO
S63
$T_a \geqq A_3$
YES
NO
$T_a=A_3$
S65
RESET DRIVING CONDITION D (D=2)
S64
S61
RESET DRIVING CONDITION D (D=3)
$B=T_a$
S62
RESET PERIOD $T_b$ ($T_b=0$)
S59
RESET PERIOD $T_a$ ($T_a=0$)
START MEASURING PERIOD $T_a$
S53
EXECUTE DISPLAY REWRITE
S54
END

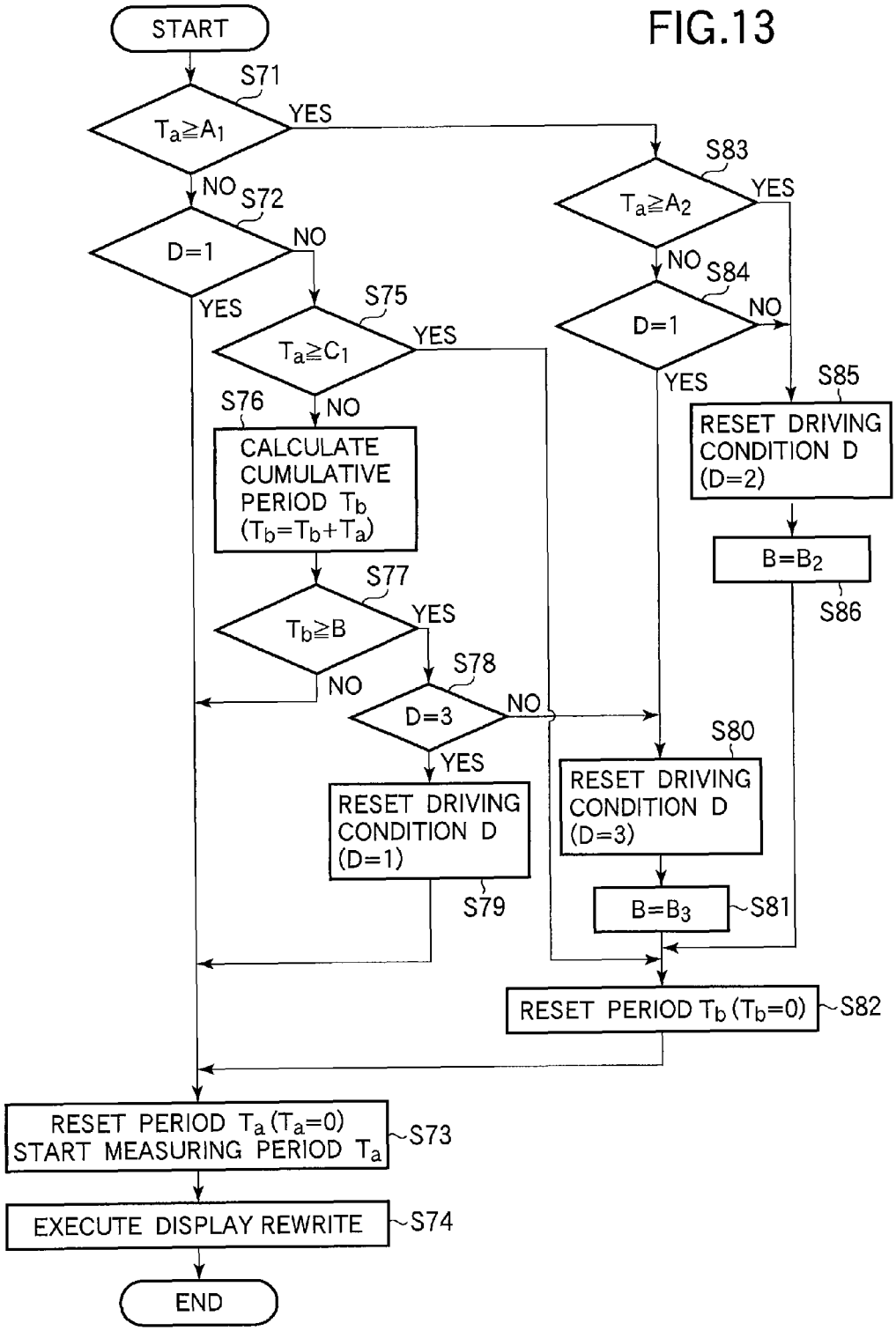
FIG.13
START
S71
$T_a \geqq A_1$
YES
NO
S72
D=1
NO
YES
S75
$T_a \geqq C_1$
YES
NO
S76
CALCULATE CUMULATIVE PERIOD $T_b$ ($T_b=T_b+T_a$)
S77
$T_b \geqq B$
YES
NO
S78
D=3
NO
YES
RESET DRIVING CONDITION D (D=1)
S79
S83
$T_a \geqq A_2$
YES
NO
S84
D=1
NO
YES
S85
RESET DRIVING CONDITION D (D=2)
$B=B_2$
S86
S80
RESET DRIVING CONDITION D (D=3)
$B=B_3$
S81
RESET PERIOD $T_b$ ($T_b=0$)
S82
RESET PERIOD $T_a$ ($T_a=0$)
START MEASURING PERIOD $T_a$
S73
EXECUTE DISPLAY REWRITE
S74
END

LIQUID CRYSTAL DISPLAY ELEMENT AND METHOD OF DRIVING THE ELEMENT

This application is a continuation of International Application No. PCT/JP2007/072567, filed Nov. 21, 2007.

BACKGROUND OF THE INVENTION

1. Field of the Invention

The present invention relates to a liquid crystal display element displaying images utilizing a cholesteric liquid crystal layer having memory characteristics and a method of driving the element.

2. Description of the Related Art

Recently, various enterprises and universities are actively engaged in the development of electronic paper. Various applied portable apparatus have been proposed as promising markets of applications of electronic paper, including electronic books which are the most promising of all, sub-displays of mobile terminal apparatus, and display sections of IC cards. One of advantageous display methods for electronic paper is the use of a display element utilizing a liquid crystal composition (a cholesteric liquid crystal) in which a cholesteric phase is formed. A cholesteric liquid crystal has advantageous characteristics such as semi-permanent display retention characteristics (memory characteristics), vivid color display characteristics, high contrast characteristics, and high resolution characteristics.

A cholesteric liquid crystal has bi-stability (memory characteristics), and the liquid crystal can be put in any of a planar state, a focal conic state, or an intermediate state that is a mixture of the planar state and the focal conic state by adjusting the intensity of an electric field applied to the same. Once the liquid crystal enters the planar state, or the focal conic state, the state is thereafter maintained with stability even if there is no electric field.

The planar state can be obtained by applying a predetermined high voltage to a liquid crystal to apply a strong electric field to the same and thereafter nullifying the electric field abruptly. For example, the focal conic state can be obtained by applying a predetermined voltage lower than the high voltage to the liquid crystal to apply an electric field to the same and thereafter nullifying the electric field abruptly. The intermediate state that is a mixture of the planar and focal conic states can be obtained by, for example, applying a voltage lower than the voltage to obtain the focal conic state to the liquid crystal to apply an electric field to the same and thereafter nullifying the electric field abruptly.

Principles of display operations of a liquid crystal display element utilizing such a cholesteric liquid crystal will now be described with reference to FIGS. 14A and 14B using a B display portion 46*b* for displaying blue as an example. FIG. 14A shows alignment of liquid crystal molecules 33 of the cholesteric liquid crystal observed when a B liquid crystal layer 43*b* of the B display portion 46*b* is in the planar state. FIG. 14B shows alignment of the liquid crystal molecules 33 of the cholesteric liquid crystal observed when the B liquid crystal layer 43*b* of the B display portion 46*b* is in the focal conic state.

As shown in FIG. 14A, in the planar state, the liquid crystal molecules 33 are sequentially rotated in the direction of the thickness of substrates to form a helical structure, and the helical axis of the helical structure is substantially perpendicular to the substrate surfaces. In the planar state, light rays having predetermined wavelengths in accordance with the helical pitch of the liquid crystal molecules are selectively reflected by the liquid crystal layer. A wavelength $\lambda$ at which maximum reflection takes place is given by $\lambda=n\cdot p$ where n represents the average refractive index of the liquid crystal layer and p represents the helical pitch.

Therefore, in order to allow blue light to be selectively reflected by the B liquid crystal layer 43*b* of the B display portion 46*b* in the planar state, the average refractive index n and the helical pitch p are determined, for example, such that an equation "$\lambda$=480 nm" holds true. The average refractive index n can be adjusted by selecting the liquid crystal material and the chiral material appropriately, and the helical pitch p can be adjusted by adjusting the chiral material content.

As shown in FIG. 14B, in the focal conic state, the liquid crystal molecules 33 are sequentially rotated in an in-plane direction of the substrates to form a helical structure, and the helical axis of the helical structure is substantially parallel to the substrate surfaces. In the focal conic state, the B liquid crystal layer 43*b* loses the selectivity of wavelengths to be reflected, and most of incident light rays are transmitted. Since the transmitted light rays are efficiently absorbed by a light-absorbing layer disposed, for example, on a bottom surface of a bottom substrate 49*b* of the B display portion 46*b*, a dark state (black) can be displayed.

As thus described, reflection and transmission of light by the cholesteric liquid crystal can be controlled by helically twisted states of alignment of the liquid crystal molecules 33. Cholesteric liquid crystals selectively reflecting green and red light in the planar state are enclosed in a G liquid crystal layer 43*g* for displaying green and an R liquid crystal layer 43*r* for displaying red, respectively, in the same manner as done for the B liquid crystal layer 43*b*, whereby a display section capable of full-color display is fabricated.

FIG. 15 shows examples of reflectance spectra observed at the B, G, and R liquid crystal layers when they are in the planar state. Wavelengths of reflected light rays are shown (in nm) along the horizontal axis, and reflectances are shown along the vertical axis (in percents in comparison to the reflectance of a white plate). The curve connecting the triangular symbols in the figure represents the reflectance spectrum observed at the B liquid crystal layer 43*b*. Similarly, the curve connecting the square symbols in the figure represents the reflectance spectrum observed at the G liquid crystal layer 43*g*, and the curve connecting the rhombic symbols in the figure represents the reflectance spectrum observed at the R liquid crystal layer 43*r*.

As shown in FIG. 15, since the center wavelengths of the reflectance spectra of the B, G, and R liquid crystal layers in the planar state have magnitudes ascending in the order in which the liquid crystal layers are listed. The helical pitches of the cholesteric liquid crystals of the B, G, and R liquid crystal layers have magnitudes ascending in the order in which the liquid crystal layers are listed. Therefore, the chiral material contents of the cholesteric liquid crystals of the B, G, and R liquid crystal layers must have magnitudes descending in the order in which the liquid crystal layers are listed.

In general, liquid crystal molecules must be twisted stronger to make the helical pitch thereof smaller, as the wavelength to be reflected is shorter. Then, the cholesteric liquid crystal of interest consequently has a high chiral material content. It is also true in general that a higher chiral material content tends to necessitate a higher driving voltage. A cholesteric liquid crystal has a greater reflection bandwidth $\Delta\lambda$, as the refractive index anisotropy $\Delta n$ of the liquid crystal is greater.

A liquid crystal display element utilizing a cholesteric liquid crystal has the property of memorizing a state of display. The element can semi-permanently retain a state of display of an image even when no electric power is supplied and can display the image in the memorized state of display.

Therefore, such an element is suitable for applications in which the same memorized image is to be displayed for a long time. However, such a liquid crystal display element has the problem of so-called image sticking that is faint persistence of a previous image occurring when the previous image is rewritten into a new image after being displayed for a long time.

It is assumed that image sticking is attributable to factors such as affinity between moisture, ionic impurities or a liquid crystal and substrate interfaces. Approaches to the mitigation of such image sticking have been proposed, including a refreshing method which involves a sequence having the steps of applying a voltage to a cholesteric liquid crystal such that the alignment of the cholesteric liquid crystal substantially becomes parallel to the voltage applying direction at regular time interval and thereafter applying a voltage associated with display data (see Patent Document 1).

There is another proposed method for preventing image sticking, including the steps of converting image data of an image using an NOT element when a predetermined period passes after the image is displayed and displaying another image based on the data obtained by the conversion (see Patent Document 2).

There is still another proposed method for preventing image sticking, including the steps of acquiring information on the ambient temperature of a liquid crystal display element and displaying a black image for preventing image sticking when a temperature change per unit time representing a temperature rise of a predetermined value or more is detected (see Patent Document 3).

Patent Document 1: JP-A-2002-14325
Patent Document 2: JP-A-2004-4200
Patent Document 3: JP-A-2004-219715

However, the degree of image sticking can vary in a complicated manner depending on the accumulation of image sticking of past images, the period for which the same image has been continuously displayed, and the influence of ambient temperature. It is therefore difficult to prevent image sticking completely using the above-described methods.

SUMMARY OF THE INVENTION

It is an object of the invention to provide a liquid crystal display element on which the generation of an afterimage attributable to image sticking can be suppressed even when image sticking occurs and to provide a method of driving the element.

The above-described object is achieved by a liquid crystal display element including a display section having memory characteristics including a cholesteric liquid crystal layer and displaying an image when a voltage is applied to the cholesteric liquid crystal layer, the section being capable of keeping the image displayed without electric power, a driving condition storing section for storing a plurality of different driving conditions including a voltage and an application period of the voltage, and a control section determining a display period for which a presently displayed image has been displayed on the display section having memory characteristics when the displayed image is rewritten into a new image, acquiring a driving condition according to the display period from the driving condition storing section, and causing the display section having memory characteristics to display the new image based on the acquired driving condition.

The above-described object is achieved by a method of driving a liquid crystal display element, including the steps of determining a display period for which a presently displayed image has been displayed on a display section having memory characteristics when the displayed image is rewritten into a new image, the display section including a cholesteric liquid crystal layer and displaying an image when a voltage is applied to the cholesteric liquid crystal layer, the section being capable of keeping the image displayed without electric power, acquiring a driving condition according to the display period from a driving condition storing section, and causing the display section having memory characteristics to display the new image based on the acquired driving condition.

The invention makes it possible to provide a liquid crystal display element on which the generation of an afterimage attributable to image sticking can be suppressed even when image sticking occurs.

BRIEF DESCRIPTION OF THE DRAWINGS

FIG. 12 is a flow chart for explaining processes and operations for driving a liquid crystal display element performed by a control section according to the fourth embodiment of the invention;

FIG. 13 is a flow chart for explaining processes and operations for driving a liquid crystal display element performed by a control section according to a fifth embodiment of the invention;

DETAILED DESCRIPTION OF THE INVENTION

First Embodiment

Figure 1:
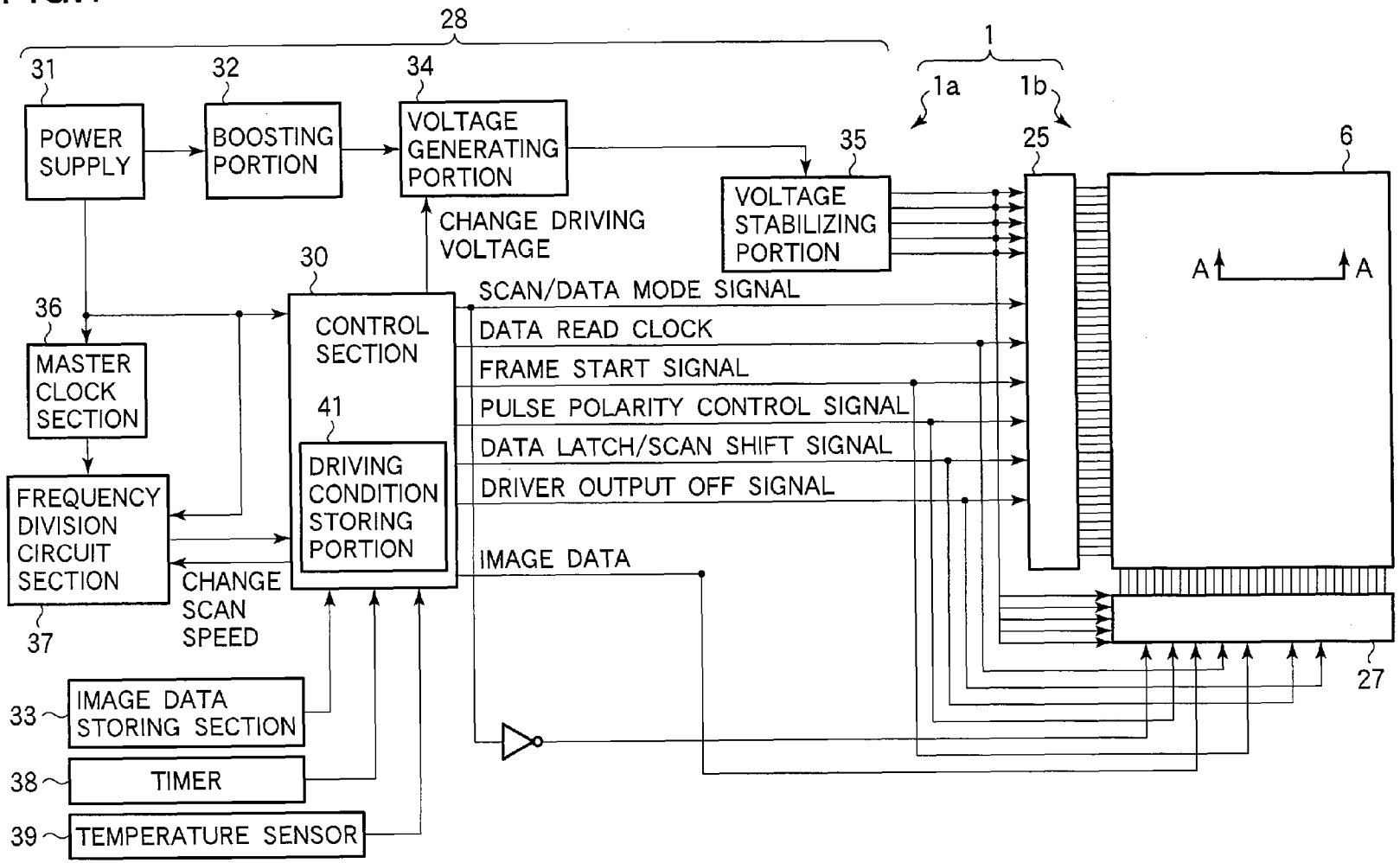
FIG. 1 is a block diagram showing a schematic configuration of a liquid crystal display element.
Figure 2:
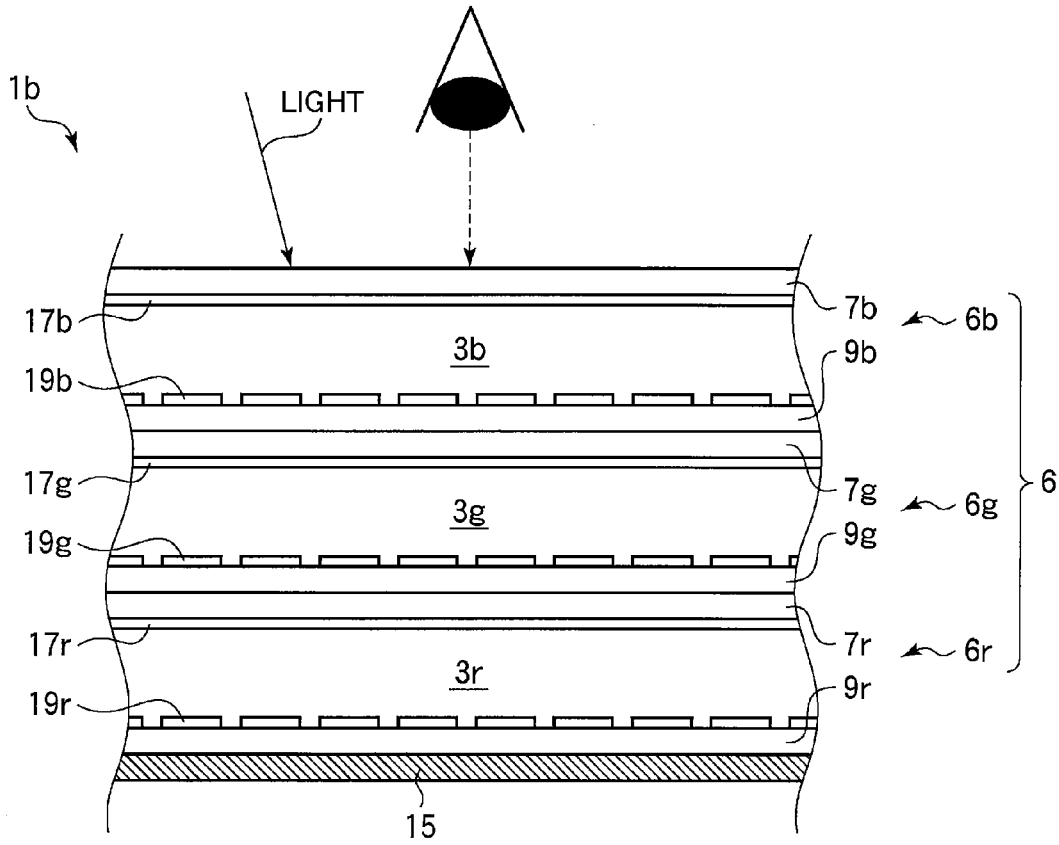
FIG. 2 is a schematic sectional view of the liquid crystal display element.

A liquid crystal display element according to a first embodiment of the invention will now be described with reference to FIGS. 1 to 8. The present embodiment is an example of a liquid crystal display element utilizing cholesteric liquid crystals for blue (B), green (G), and red (R). FIG. 1 is a block diagram showing a schematic configuration of the liquid crystal display element of the present embodiment. FIG. 2 is a schematic sectional view of a display section (display section having memory characteristics) 6 taken along the line A-A extending in the horizontal direction of FIG. 1.

As shown in FIG. 1, a liquid crystal display element 1 includes a circuit block 1*a* and a display block 1*b*. The circuit block 1*a* includes a power supply section 28, an image data storing section 33, a timer 38, a temperature sensor 39, a master clock section 36, a frequency division circuit section 37, and a control section 30.

The display block 1*b* includes a display section 6, a scan electrode driving circuit 25, and a data electrode driving circuit 27.

The power supply section 28 includes a power supply 31, a boosting portion 32, a voltage generating portion 34, and a voltage stabilizing portion 35. The power supply 31 is a battery which outputs DC voltages. For example, the boosting portion 32 includes a DC-DC converter, and it boosts an input voltage of, for example, 3 V to 5 V d.c. from the power supply 31 to a voltage of about 10 V to about 40 V required to drive the display section 6. The voltage generating portion 34 generates a plurality of required voltage levels which depend on a gray level value to be provided at each pixel and depend on whether each pixel is selected or not, using the voltage boosted by the boosting portion 32 and the input voltage. The voltage stabilizing portion 35 includes a Zener diode, an operational amplifier, and the like. It stabilizes the voltages generated by the voltage generating portion 34 and supplies the voltages to the scan electrode driving circuit 25 and the data electrode driving circuit 27 provided in the display block 1*b*. The power supply 31 also supplies predetermined voltages to features other than the boosting portion 32, i.e., the control section 30, master clock section 36, and the frequency division circuit section 37.

Image data input from a system are stored in the image data storing section 33, and image data are output from the section to the control section 30 under control exercised by the control section 30.

The timer 38 is a counter measuring periods of time. For example, the timer measures an elapsed period for which an image has been displayed on the display section 6 and outputs elapsed period data to the control section 30 based on the elapsed period.

The temperature sensor 39 detects the temperature of the environment in which the liquid crystal display element 1 is situated. The control section 30 can optimally control the display section 6 according to the temperature detected by the temperature sensor 39.

The master clock section 36 generates a clock signal and outputs it to the frequency division circuit section 37.

The frequency division circuit section 37 outputs a clock signal obtained by performing frequency division of the clock signal output from the master clock section 36 using a predetermined frequency division ratio, whereby scan speed is switched. A bit array for controlling the scan speed is input from the control section 30 to the frequency division circuit section 37, and a counter frequency division ratio for controlling the scan speed is changed according to the value of the bit array. Specifically, an initial value of a frequency division counter (not shown) provided in the frequency division circuit section 37 is switched at each scan.

The control section 30 includes a processor, which is not shown, a driving condition storing portion 41 and the like, and the section controls the liquid crystal display element 1 as a whole. The control section 30 switches the scan speed and driving voltages of the display section 6 through the scan electrode driving circuit 25 and the data electrode driving circuit 27 to display an image, and the control section 30 also executes a process of resetting a display area.

The control section 30 applies voltages in the form of driving pulses to the display section 6 through the scan electrode driving circuit 25 and the data electrode driving circuit 27. The control section 30 drives the display section 6 as thus described to display an image.

The voltage of a driving pulse used to drive the display section 6 is changed by the control section 30 which gives a voltage change instruction to the voltage generating portion 34 to control voltages supplied from the voltage generating portion 34 to the scan electrode driving circuit 25 and the data electrode driving circuit 27.

The display section 6 is controlled according to a line sequential driving method in which linear scan electrodes 17*b*, 17*g*, and 17*r* (see FIG. 2) arranged at substantially equal intervals are sequentially scanned. An application time (application period) of a driving pulse voltage changes as a result of a change in the scan speed of the scan electrode driving circuit 25 that is controlled by the control section 30. The control section 30 controls the data electrode driving circuit 27 such that a predetermined voltage based on image data is output to the display section 6 in synchronism with scan timing of the scan electrode driving circuit 25.

The control section 30 includes a driving condition storing portion 41 for storing driving conditions for generating a driving pulse based on a voltage and a voltage application period for the voltage, the driving conditions being stored as driving condition data. Plural sets of different driving condition data are stored in the driving condition storing portion 41. The driving condition data are associated with respective sets of driving conditions for generating driving pulses having different voltages and different application periods. The control section 30 selects one of the plural sets of driving condition data stored in the driving condition storing portion 41. The control section 30 gives a voltage change instruction to the voltage generating portion 34 and causes the scan electrode driving circuit 25 to change the scan speed based on the driving condition associated with the selected driving condition data. Thus, a driving pulse generated based on the selected driving condition data is applied to the display section 6.

Information on various periods to be used for determination processes performed by the control section 30 is also stored in the driving condition storing portion 41, the period information including an image sticking occurrence period, an image sticking elimination period, an image sticking occurrence determination period (display period) Ta, and an image sticking elimination determination period Tb.

An image sticking occurrence period is a period based on which it is considered that image sticking has occurred on the display section 6.

An image sticking elimination period is a period based on which it is considered that image sticking on the display section 6 has been eliminated.

An image sticking occurrence determination period Ta is a display period for which a presently displayed image has been displayed. An image sticking occurrence determination period Ta is measured using the timer 38. An image sticking occurrence determination period Ta is compared with an image sticking occurrence period to determine whether the presently displayed image has stuck to the display section 6 or not.

An image sticking elimination determination period Tb is a period which has passed since a certain driving condition is set or changed. An image sticking elimination determination period Tb is measured by the timer 38. An image sticking elimination determination period Tb is compared with an image sticking elimination period to determine whether image sticking on the display section 6 has been eliminated or not.

The control section 30 generates driving data based on image data and driving condition data for each of display portions 6*r*, 6*g*, and 6*b* (see FIG. 2) read out from the image data storing section 33. The control section 30 outputs the driving data thus generated to the scan electrode driving circuit 25 and the data electrode driving circuit 27 in synchronism with a data read clock signal. The control section 30 outputs the driving data to the scan electrode driving circuit 25 to cause it to change the scan speed thereof. The control section 30 outputs control signals such as a scan/data mode signal, frame start signal, a pulse polarity control signal, a data latch/scan shift signal, and a driver output off signal to the scan electrode driving circuit 25 and the data electrode driving circuit 27.

As shown in FIG. 2, the display section 6 includes a B display portion 6*b* having a B liquid crystal layer (cholesteric liquid crystal layer) 3*b* reflecting blue light in the planar state, a G display portion 6*g* having a G liquid crystal layer (cholesteric liquid crystal layer) 3*g* reflecting green light in the planar state, and an R display portion 6*r* having an R liquid crystal layer (cholesteric liquid crystal layer) 3*r* reflecting red light in the planar state. The display section 6 can hold an image displayed thereon in an unpowered state in which no electric power is supplied to the section. That is, the display section 6 has memory display characteristics which allow an image to be displayed in a memorized state of display as a memorized display image. The B display portion 6*b*, the G display portion 6*g*, and the R display portion 6*r* are formed in the order listed from the side of the section where a display surface is provided, light entering the section through the surface.

The B display portion 6*b* includes a pair of substrates, i.e., a top substrate 7*b* and a bottom substrate 9*b* disposed opposite to each other and the B liquid crystal layer 3*b* which is enclosed between the substrates 7*b* and 9*b*. The display surface is provided on the top substrate 7*b*, and external light impinges on the display surface on the substrate 7*b* from above as indicated by the arrow in a solid line. FIG. 2 schematically shows an eye of a viewer and the viewing direction (indicated by the arrow in a broken line) of the viewer above the substrate 7*b*. The B liquid crystal layer 3*b* includes a cholesteric liquid crystal for blue (B) having an average refractive index n and a helical pitch p adjusted to reflect blue light selectively.

The G display portion 6*g* includes a pair of substrates, i.e., a top substrate 7*g* and a bottom substrate 9*g* disposed opposite to each other and the G liquid crystal layer 3*g* which is enclosed between the substrates 7*g* and 9*g*. The G liquid crystal layer 3*g* includes a cholesteric liquid crystal for green (G) having an average refractive index n and a helical pitch p adjusted to reflect green light selectively.

The R display portion 6*r* includes a pair of substrates, i.e., a top substrate 7*r* and a bottom substrate 9*r* disposed opposite to each other and the R liquid crystal layer 3*r* which is enclosed between the substrates 7*r* and 9*r*. The R liquid crystal layer 3*r* includes a cholesteric liquid crystal for red (R) having an average refractive index n and a helical pitch p adjusted to reflect red light selectively. A light absorbing layer 15 is disposed on a bottom surface of the bottom substrate 9*r*.

The liquid crystal compositions forming the B, G, and R liquid crystal layers 3*b*, 3*g*, and 3*r* are cholesteric liquid crystals obtained by adding a chiral additive or chiral material to a nematic liquid crystal mixture to a content of several tens percent by weight, e.g., 10 to 40 percent by weight. When a nematic liquid crystal includes a relatively great amount of chiral material, a cholesteric phase, which is a great helical twist of a layer of nematic liquid crystal molecules, can be formed in the liquid crystal. The cholesteric liquid crystal is also referred as the chiral nematic liquid crystal. The chiral material content is a value based on an assumption that the total amount of the nematic liquid crystal component and the chiral material constitutes 100 percent by weight. Although various types of nematic liquid crystals known in the related art may be used, the cholesteric liquid crystal compositions preferably have dielectric constant anisotropy $\Delta\in$ satisfying $20 \leqq \Delta\in \leqq 50$. The chiral material used can be selected from among a wide range of materials when dielectric constant anisotropy $\Delta\in$ of 20 or more is acceptable. Dielectric constant anisotropy $\Delta\in$ lower than the range necessitates excessively high driving voltages for the liquid crystal layers 3*b*, 3*g*, and 3*r*. Dielectric constant anisotropy $\Delta\in$ higher than the range reduces the stability and reliability of the display section 6, and the section will be vulnerable to image defects and image noises.

Refractive index anisotropy $\Delta n$ of a cholesteric liquid crystal is an important physical property which dominates image quality. Refractive index anisotropy $\Delta n$ satisfying $0.18 \leqq \Delta n \leqq 0.24$ is preferable. Refractive index anisotropy $\Delta n$ lower than the range makes the reflectance of the liquid crystal layers 3*b*, 3*g*, and 3*r* in the planar state low, and a dark image having insufficient brightness will therefore be displayed. Refractive index anisotropy $\Delta n$ higher than the range results in significant scatter reflections in the liquid crystal layers 3*b*, 3*g*, and 3*r* in the focal conic state, and the display screen consequently has insufficient color purity and contrast which can result in a blurred image. Further, the cholesteric liquid crystals have high viscosity when they have refractive index anisotropy $\Delta n$ higher than the range, and the speed of response of the cholesteric liquid crystals is reduced.

The cholesteric liquid crystals preferably have a specific resistance $\rho$ satisfying $10^{10} \leqq \rho \leqq 10^{13}$ $\Omega\cdot$cm. A voltage increase and degradation of contrast at a low temperature can be more effectively suppressed, as the viscosity of the cholesteric liquid crystals is lower.

In the multi-layer structure formed by the display portions 6*b*, 6*g*, and 6*r*, the optical rotatory power of the G liquid crystal layer 3*g* is different from the optical rotatory power of the B liquid crystal layer 3*b* and the R liquid crystal layer 3*r* in the planar state. As a result, in the regions where overlaps exist between the blue and green reflectance spectra and between the green and red reflectance spectra, right-handed circularly polarized light can be reflected by the B liquid crystal layer 3*b*, and left-handed circularly polarized light can be reflected by the G liquid crystal layer 3*g*. As a result, loss of reflected light can be suppressed to improve the brightness of the display screen of the display section 6.

The top substrates 7*b*, 7*g*, and 7*r* and the bottom substrates 9*b*, 9*g*, and 9*r* have translucency. In the present embodiment, pairs of glass substrates are used. Film substrates made of polycarbonate (PC), polyethylene terephthalate (PET) or the like may be used instead of glass substrates. While all of the top substrates 7*b*, 7*g*, and 7*r* and the bottom substrates 9*b*, 9*g*, and 9*r* in the present embodiment have translucency, the bottom substrate 9*r* of the R display portion 6*r* disposed as the lowermost layer may be opaque.

A plurality of strip-like scan electrodes 17*b* extending in the horizontal direction of FIG. 2 are formed in parallel on the side of the top substrate 7*b* of the B display portion 6*b* facing the B liquid crystal layer 3*b*. A plurality of strip-like data electrodes 19*b* extending substantially orthogonally to the scan electrodes 17*b* are formed in parallel on the side of the bottom substrate 9*b* facing the B liquid crystal layer 3*b*. In the present embodiment, the plurality of scan electrodes 17*b* and the plurality of data electrodes 19*b* in the form of stripes are formed by patterning transparent electrodes made of an indium tin oxide (ITO). Although an ITO is a typical material used to form the electrodes 17*b* and 19*b*, transparent conductive films made of an indium zinc oxide (IZO) or photoconductive films made of amorphous silicon may alternatively be used.

The electrodes 17*b* and 19*b* are formed opposite to each other in an intersecting relationship when viewed in the normal direction of the surfaces of the top substrate 7*b* and the bottom substrate 9*b* on which the electrodes are formed. Each of regions where the electrodes 17*b* and 19*b* intersect constitutes a pixel. A plurality of pixels are defined by the electrodes 17*b* and 19*b* and arranged in the form of a matrix to constitute a display screen.

Preferably, each of the groups of electrodes 17*b* and 19*b* is coated with a functional film, e.g., an insulating thin film or a film for stabilizing the alignment of liquid crystal molecules (neither of such films is shown). The insulating thin film has the function of preventing shorting between the electrodes 17*b* and 19*b*, and the film also serves as a gas barrier layer having the function of improving the reliability of the display section 6. A polyimide resin or an acryl resin may be used as the alignment stabilizing film. In the present embodiment, for example, an alignment stabilizing film is applied to coat the entire surface of each of the substrates having the electrodes 17*b* and 19*b* thereon. The alignment stabilizing films may be also used as insulating thin films.

The B liquid crystal layer 3*b* is enclosed between the substrates 7*b* and 9*b* by a seal material 18*b* applied to the peripheries of the top substrate 7*b* and the bottom substrate 9*b*. The thickness (cell gap) of the B liquid crystal layer 3*b* must be kept uniform. In order to maintain a predetermined cell gap, spherical spacers made of a resin or inorganic oxide are dispersed in the B liquid crystal layer 3*b*. Alternatively, a plurality of columnar spacers coated with a thermoplastic resin on the surface thereof may be formed in the B liquid crystal layer 3*b*. In the display section 6 of the present embodiment, spacers (not shown) are inserted in the B liquid crystal layer 3*b* to keep the cell gap uniform. The B liquid crystal layer 3*b* preferably has a cell gap d in a range expressed by $3\ \mu m \leqq d \leqq 6\ \mu m$.

The structure of the G display portion 6*g* and the R display portion 6*r* will not be described because it is similar to the structure of the B display portion 6*b*. A visible light absorbing layer 15 is provided on an outer surface (bottom surface) of the bottom substrate 9*r* of the R display portion 6*r*. Therefore, when all of the B, G, and R display portions 3*b*, 3*g*, and 3*r* are in the focal conic state, black is displayed on the display screen of the display section 6. The visible light absorbing layer 15 may be provided as occasion demands.

The scan electrode driving circuit 25, which has scan electrode driver ICs mounted thereon for driving the plurality of scan electrodes 17*b*, 17*g*, and 17*r* independently, is connected to the top substrates 7*b*, 7*g*, and 7*r*. The data electrode driving circuit 27, which has data electrode driver ICs mounted thereon for driving the plurality of data electrodes 19*b*, 19*g*, and 19*r* independently, is connected to the bottom substrates 9*b*, 9*g*, and 9*r*. The driving circuits 25 and 27 generate driving pulses including scan signals and data signals in the form of pulses based on driving data output from the control section 30 and voltages supplied from the voltage stabilizing portion 35. The driving circuits 25 and 27 are provided to output driving pulses thus generated to predetermined ones among the scan electrodes 17*b*, 17*g*, and 17*r* and the data electrodes 19*b*, 19*g*, and 19*r*.

The liquid crystal display element 1 may be provided with an input/output device and a control device for exercising overall control of the element (neither of the devices is shown) to configure electronic paper. Such electronic paper may be used as a display of an electronic terminal apparatus. Such an electronic terminal apparatus may be used as a display of a display system.

Figure 3:
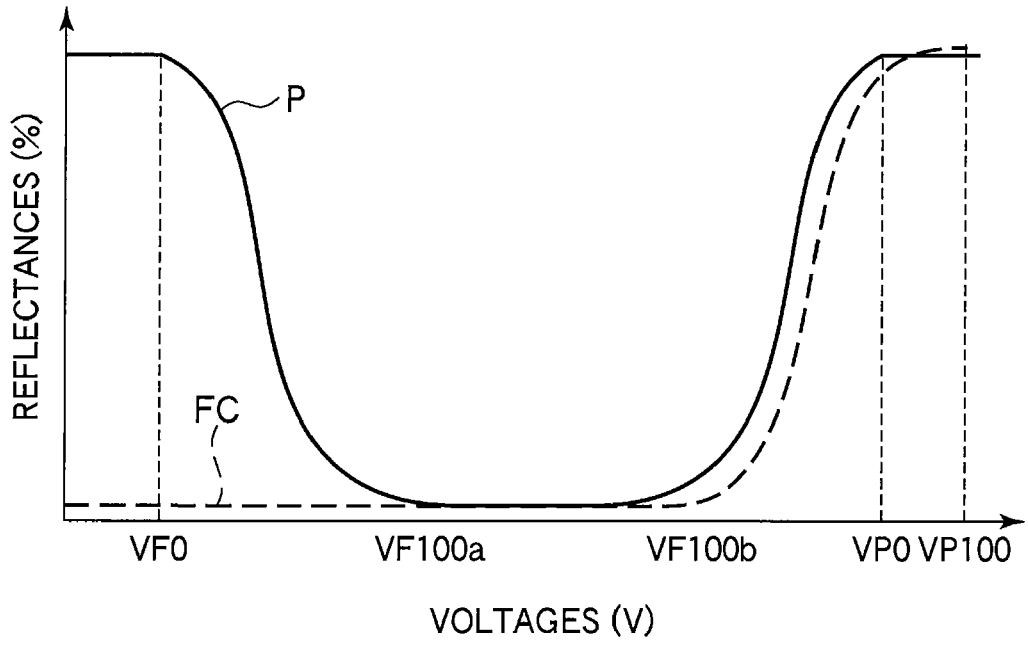
FIG. 3 is a graph showing an example of voltage-reflectance characteristics of a cholesteric liquid crystal.

FIG. 3 is a graph showing an example of voltage-reflectance characteristics of a cholesteric liquid crystal. Voltages (V) applied to the cholesteric liquid crystal are shown along the horizontal axis, and reflectances (%) of the cholesteric liquid crystal are shown along the vertical axis. The curve P in a solid line shown in FIG. 3 represents voltage-reflectance characteristics observed when the cholesteric liquid crystal is initially in the planar state, and the curve FC in a broken line represents voltage-reflectance characteristics observed when the cholesteric liquid crystal is initially in the focal conic state.

To switch the cholesteric liquid crystal from the focal conic state (transparent state) to the planar state (reflective state), a predetermined high voltage VP100 (e.g., 32 V) is applied to the cholesteric liquid crystal for a period of several ms to several tens ms. When a strong electric field is thus generated, the helical structure of the liquid crystal molecules is completely decomposed, and the liquid crystal enters a homeotropic state in which all of the liquid crystal molecules follow the direction of the electric field. When the voltage applied to the liquid crystal is thereafter abruptly decreased from the voltage VP100 to substantially zero, the liquid crystal molecules enter a helical state in which their helical axes are oriented substantially perpendicularly to electrodes on both sides of the layer, and the liquid crystal enters the planar state to reflect light rays according to the helical pitch selectively.

To switch the cholesteric liquid crystal from the planar state (reflective state) to the focal conic state (transparent state), a predetermined voltage VF100 (e.g., 24 V) between voltages VF100*a* and VF100*b* is applied for a period of several ms to several tens ms, and the voltage applied to the liquid crystal is thereafter abruptly decreased from the voltage VF100 to substantially zero.

Thus, the liquid crystal molecules enter a helical state in which their helical axes are oriented substantially parallel to the electrodes, and the liquid crystal enters the focal conic state in which incident light are transmitted. The cholesteric liquid crystal can be changed to the focal conic state also by applying the voltage VP100 to generate a strong electric field in the liquid crystal layer and thereafter removing the electric field slowly.

Intermediate gray levels can be displayed using the curve between the voltages VF0 and VF100*a* representing a transition from the planar state to the focal conic state shown in FIG. 3 or the curve between the voltages VF100*b* and VP0 representing a transition from the focal conic state to the homeotropic state. An arbitrary intermediate density can be obtained by changing at least either of the magnitude or application period of an applied voltage.

The voltage-reflectance characteristics of a cholesteric liquid crystal shown in FIG. 3 are obtained by applying pulse voltages having the same pulse width. Alternatively, cumulative response characteristics of the cholesteric liquid crystal can be obtained by varying the pulse width of the pulse voltages. For example, let us assume that two types of pulse voltages having the same voltage value but having different pulse widths are applied within the voltage range between the voltages VF0 and VF100*a*. Then, a lower reflectance can be achieved when the pulse voltage having the greater pulse width is applied than when the pulse voltage having the smaller pulse width is applied.

Image sticking is the generation of an afterimage which is considered attributable to a display density difference resulting from a difference between the response of a liquid crystal observed when the liquid crystal has been kept in the planar state (reflective state) for a certain period and the response of the liquid crystal observed when the liquid crystal has been kept in the focal conic state (transparent state) for a certain period. Such a display density difference is considered to become more significant, as the voltages of driving pulses applied to the liquid crystal are higher, and as the application periods of the voltages are shorter. It is also considered that such a difference is significant especially when intermediate gray levels are displayed.

Figure 4:
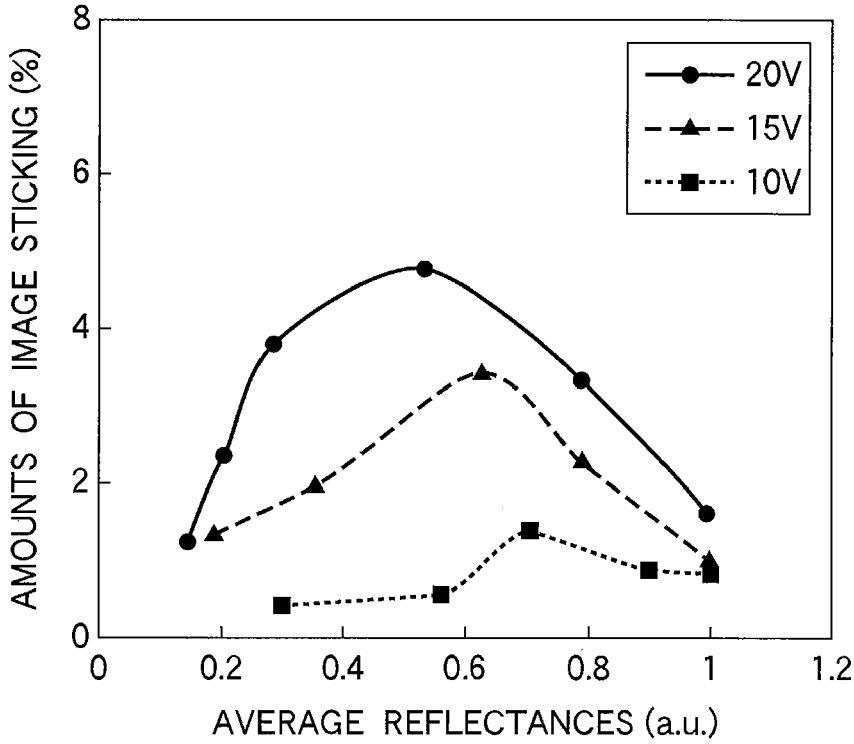
FIG. 4 is a graph showing a relationship between reflectances of a pixel and amounts of image sticking.

FIG. 4 is a graph showing a relationship between reflectances of pixels and amounts of image sticking.

FIG. 4 shows results of display rewrites carried out to obtain the same image at a pixel which has stayed in the planar state for seven consecutive days and a pixel which has stayed in the focal conic state for seven consecutive days. In FIG. 4, average reflectances of the pixels are shown using an arbitrary unit along the horizontal axis, and amounts of image sticking are shown (in percents) along the vertical axis. Let us define that an amount of image sticking is the ratio of a calculated reflectance difference $\Delta Y$ to the reflectance of the liquid crystal display element of interest in the planar state, i.e., the maximum reflectance of the element where the reflectance difference $\Delta Y$ is a difference between a reflectance measured at the pixel which has stayed in the planar state for seven consecutive days after rewriting the pixel and a reflectance measured at the pixel which has stayed in the focal conic state for seven consecutive days after rewriting the pixel. Each pixel is rewritten by applying a driving pulse in the range from 10 V to 20 V to the pixel after resetting the entire display surface to the planar state using a voltage of about 36 V. The curve connecting the square symbols in the figure represents results of the application of a driving pulse at 10 V. The curve connecting the triangular symbols in the figure represents results of the application of a driving pulse at 15 V. The curve connecting the circular symbols in the figure represents results of the application of a driving pulse at 20 V.

As shown in FIG. 4, great amounts of image sticking occur to leave a highly visible afterimage especially when intermediate gray levels are displayed at average reflectances in the range from about 0.4 to about 0.7. Greater amounts of image sticking occur to leave a more visible afterimage, as the voltage of the driving pulse applied is higher. The visibility of an afterimage depends on the image which has been displayed. To keep an afterimage not so noticeable or to keep the afterimage at an allowable level, the amount of image sticking is preferably kept at about 3% or less and more preferably at about 2% or less.

Figure 5:
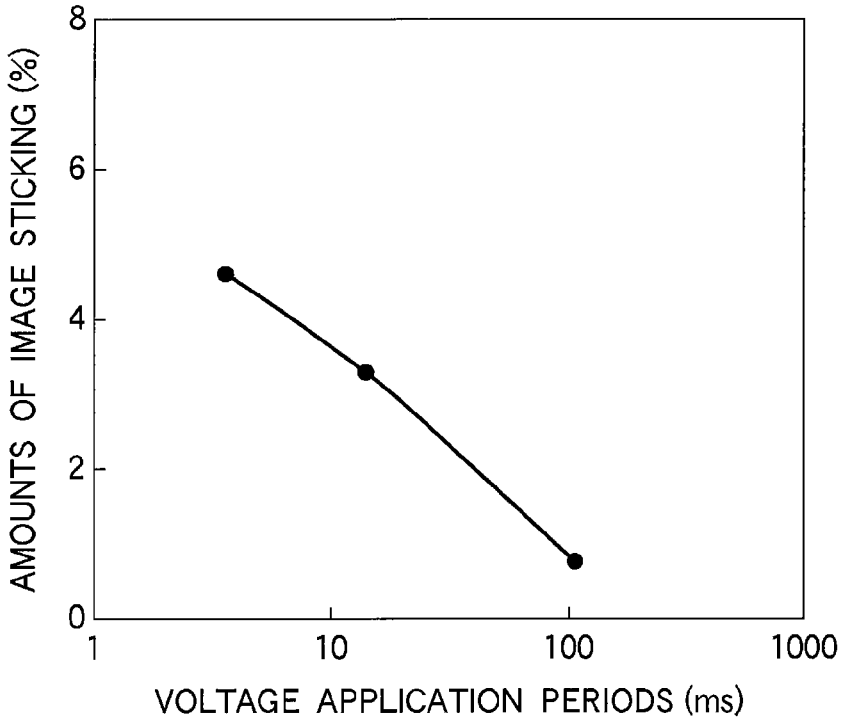
FIG. 5 is a graph showing a relationship between voltage application periods of a driving pulse and amounts of image sticking occurring at a pixel having a reflectance of 0.6.

FIG. 5 is a graph showing a relationship between voltage application periods of a driving pulse and amounts of image sticking occurring at a pixel having a reflectance of 0.6. In order to keep the reflectance of the pixel unchanged when the voltage application period of the driving pulse is varied, the voltage application period must be longer, as the voltage is lower. That is, the voltage application period must be shorter, as the voltage is higher. In FIG. 5, voltage application periods (ms) are shown along the horizontal axis, and amounts of image sticking (%), to which the definition given above with reference to FIG. 4 applies, are shown along the vertical axis.

As shown in FIG. 5, a smaller amount of image sticking occurs to leave a less visible afterimage, as the voltage of the driving pulse is lower, i.e., as the application period is longer. It is therefore preferable to use a driving pulse having a low voltage and a long application period in order to keep an afterimage attributable to image sticking less visible. However, when a driving pulse is applied for a long period, an image rewrite will take a long time. On the contrary, a greater amount of image sticking occurs, as the voltage of the driving pulse is higher, i.e., as the application period is shorter. It is preferable to use a driving pulse having a high voltage and a short application period in order to keep the time required for a rewrite short.

A method of driving the liquid crystal display element of the present embodiment will now be schematically described.

Figure 6:
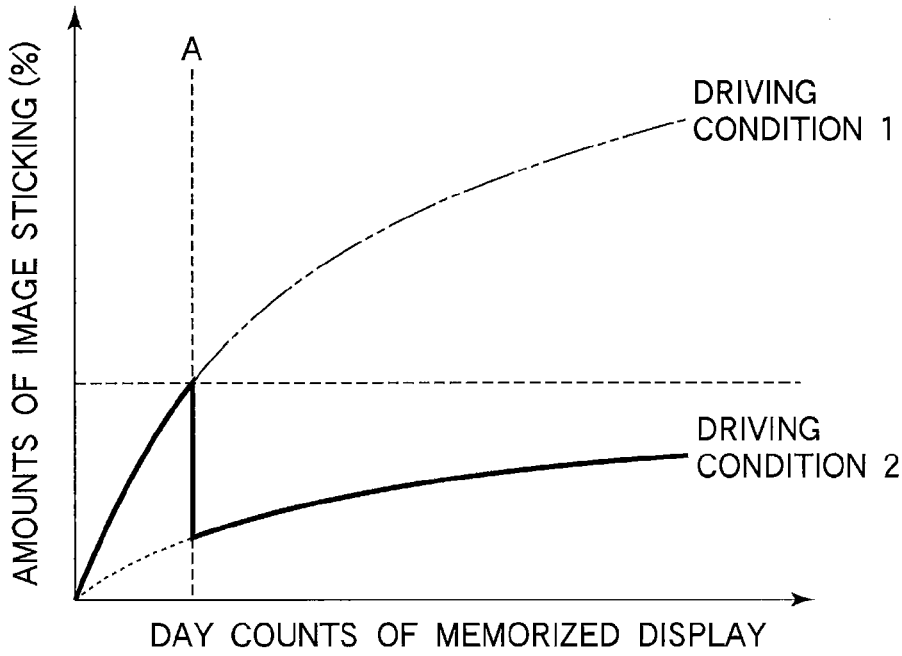
FIG. 6 is a conceptual diagram representing a method of driving a liquid crystal display element according to a first embodiment of the invention.

FIG. 6 is a conceptual diagram representing the method of driving the liquid crystal display element of the present embodiment.

In FIG. 6, the horizontal axis represents counts of consecutive days on which an image is displayed in a memorized state of display before the image is rewritten, and the vertical axis represents amounts of image sticking (%) to which the definition given with reference to FIGS. 4 and 5 applies.

In the liquid crystal display element 1 of the present embodiment, the display section 6 is normally driven to display an image by a driving pulse generated based on a driving condition 1 that is a standard driving condition, i.e., a voltage having a high magnitude and a short application period. The liquid crystal display element 1 displays an image as a memorized display image in an unpowered state in which the supply of a voltage to the display section 6 is interrupted. When the image displayed in a memorized state of display is rewritten into a new image, the new image is displayed using the driving pulse generated based on the driving condition 1 if the number of days on which the present image has been displayed in a memorized state of display is less than a day count A that is a period during which image sticking in an amount equal to or higher than the allowable level occurs to leave a noticeable afterimage. The new image is thereafter displayed in a memorized state of display. On the contrary, if the number of days on which the present image has been displayed in a memorized state of display equals or exceeds the day count A, the new image is displayed using a driving pulse generated based on a driving condition 2, i.e., a voltage having a lower voltage and a longer application period compared to the driving condition 1 used to display the present image in a memorized state of display. The new image is thereafter displayed in a memorized state of display.

Figure 7:
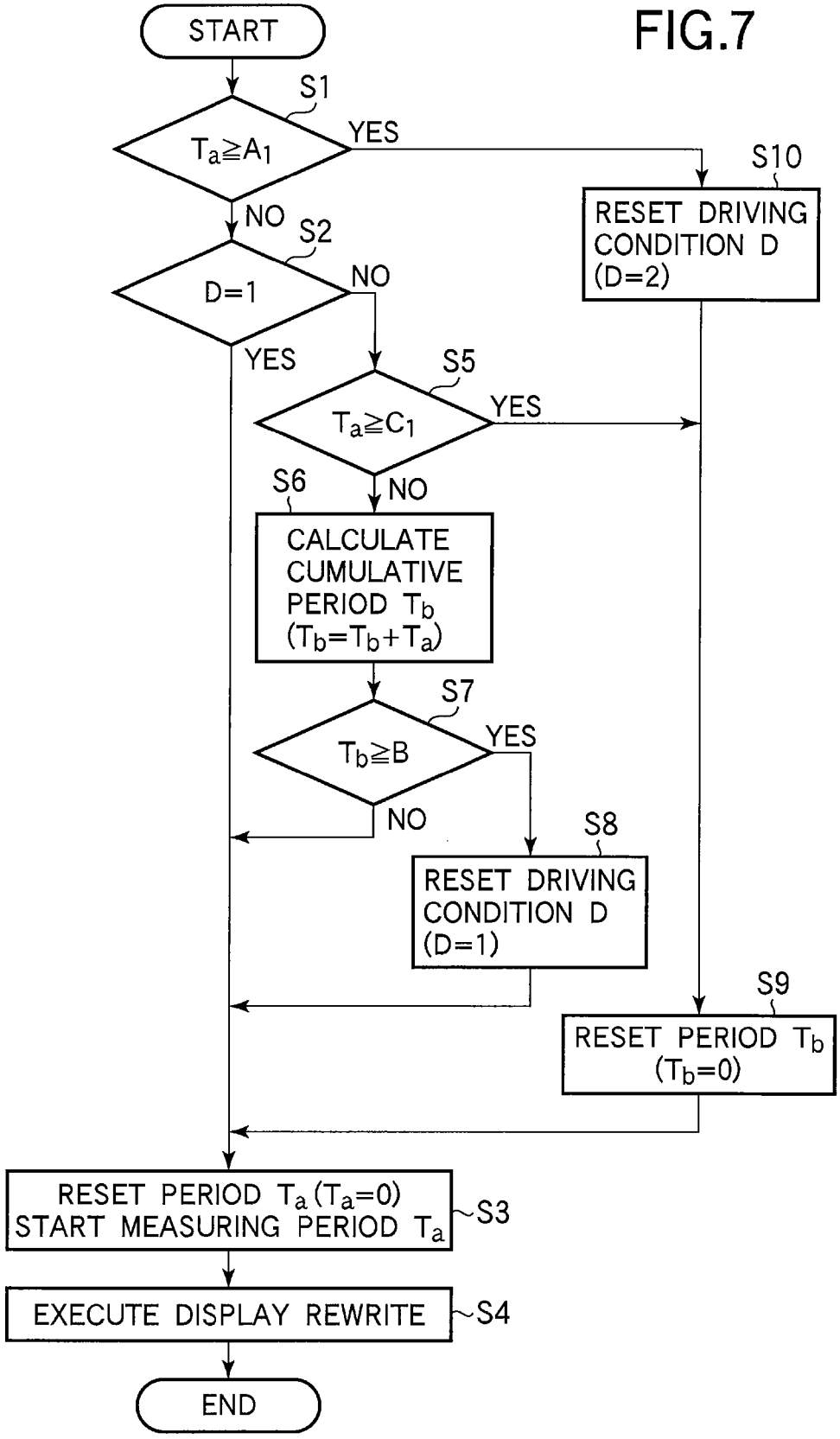
FIG. 7 is a flow chart for explaining processes and operations for driving the liquid crystal display element performed by a control section according to the first embodiment of the invention.

FIG. 7 is a flow chart for explaining processes or operations performed by the control section 30 to drive the display section 6.

A driving condition D is a condition to be set for generating a driving pulse for displaying an image on the display section 6. Driving condition data are stored in the driving condition storing portion 41 of the present embodiment. The driving condition data are associated with two types of driving conditions which are specifically the driving condition 1, i.e., a voltage of 20 V applied for an application period in the range from 1 ms to 20 ms and the driving condition 2, i.e., a voltage of 10 V applied for an application period in the range from 10 ms to 200 ms. In the present embodiment, the voltage application period of the driving condition 2 is set, for example, ten times longer than the voltage application period of the driving condition 1 when the same gray level is to be displayed under those conditions. For example, the same gray level can be displayed by applying a voltage of 20 V to the display section 6 for an application period of 1 ms and applying a voltage of 10 V to the display section 6 for an application period of 10 ms. The image sticking occurrence determination period Ta and the image sticking elimination determination period Tb have an initial value of 0 (zero).

A period A1 is an image sticking determination period serving as a reference value used for determining the degree at which a displayed image sticks to the display section 6. In the present embodiment, for example, the duration of the period A1 is four days, and it is determined that an image has stuck to the display section 6 when the period A1 has passed.

A period B is an image sticking elimination period serving as a reference value used for determining whether it can be considered that image sticking on the display section 6 has been eliminated or not. In the present embodiment, for example, the duration of the period B is three days.

A period C1 is a reference value used for determining a rewrite frequency. In the present embodiment, for example, the period C1 is one day.

First, when a rewrite is requested as a result of the input of a new image from the image data storing portion 33, the control section 30 determines whether the image sticking occurrence determination period Ta is equal to or longer than the period A1, i.e., whether the period Ta has reached the period A1 (step S1). In the present embodiment, the period A1 corresponds to the period of the day count A in FIG. 6 during which an afterimage becomes noticeable.

When it is determined that the image sticking occurrence determination period Ta of the image displayed in a memorized state of display is not equal to or longer than the period A1 (the answer at step S1 is "No"), the control section 30 determines whether the driving condition D is the driving condition 1 (D=1) or not (step S2).

When it is determined that the driving condition D is the driving condition 1 (the answer at step S2 is "Yes"), the control section 30 resets the image sticking occurrence determination period Ta to 0. After resetting the image sticking occurrence determination period Ta, the control section 30 starts measuring the image sticking occurrence determination period Ta (step S3). When the measurement of the image sticking occurrence determination period Ta is thus started, the control section 30 executes a display rewrite (step S4) and terminates the series of processes.

When it is determined at step S2 that the driving condition D is not the driving condition 1 (the answer at step S2 is "No"), the control section 30 determines whether the image sticking occurrence determination period Ta is equal to or longer than the period C1, i.e., whether the period Ta has reached the period C1 (step S5).

When it is determined that the image sticking occurrence determination period Ta does not equal or exceed the period C1 (the answer at step S5 is "No"), the control section 30 adds the image sticking occurrence determination period Ta to the image sticking elimination determination period Tb to obtain a cumulative period (Tb+Ta), and the calculation result is set as an updated image sticking elimination determination period Tb (Tb=Tb+Ta).

When an updated image sticking elimination determination period Tb is set as thus described, the control section 30 determines whether the image sticking elimination determination period Tb thus set is equal to or longer than the period B, i.e., whether the period Tb has reached the period B (step S7).

When it is determined that the image sticking elimination determination period Tb is not equal to or longer than the period B (the answer at step S7 is "No"), the control section 30 executes the process at step S3.

When it is determined at step S7 that the image sticking elimination determination period Tb is equal to or longer than the period B (the answer at step S7 is "Yes"), the control section 30 acquires the driving condition 1 from the driving condition storing portion 41 to set the driving condition 1 as the driving condition D (D=1) (step S8). At this process, the driving condition D is reset to the driving condition 1 in case that the driving condition D has been set otherwise. When the driving condition 1 is set as the driving condition D again, the control section 30 executes the process at step S3.

When it is determined at step S5 that the image sticking occurrence determination period Ta is equal to or longer than the period C1 (the answer at step S5 is "Yes"), the control section 30 resets the image sticking elimination determination period Tb to 0 and starts measuring the image sticking elimination determination period Tb (step S9). When the measurement of the image sticking elimination determination period Tb is started after resetting the same, the control section 30 executes the process at step S3.

When it is determined at step S1 that the image sticking occurrence determination period Ta of the image being displayed in a memorized state of display is equal to or longer than the period A1 (the answer at step S1 is "Yes"), the control section 30 acquires the driving condition 2 from the driving condition storing portion 41 and resets the driving condition D to the driving condition 2 (D=2) (step S10).

When the driving condition D is reset to the driving condition 2, the control section 30 executes the process at step S9.

When the image sticking occurrence determination period Ta is equal to or longer than the period A1, the control section 30 sets the driving condition 2 as the driving condition D at the above-described step. Thus, the new image can be displayed based on the driving condition 2.

Let us assume that the image sticking occurrence determination period Ta is shorter than the period C1 and the image sticking elimination determination period Tb is equal to or longer than the period B while an image is displayed based on the driving condition 2. That is, the image is rewritten at a rewrite frequency equal to or higher than once per period C1 for a period which is equal to or longer than the period B. Then, the control section 30 sets the driving condition 1 as the driving condition D, and a new image can be displayed based on the driving condition 1.

In the present embodiment, when an image displayed in a memorized state of display is rewritten into a new image, the liquid crystal display element 1 can select a driving condition for displaying the new image according to the period for which the present image has been displayed in a memorized state of display. As a result, when the present image has been displayed in the memorized state for a period based on which it is considered that image sticking has occurred, the liquid crystal display element 1 can display the new image based on a driving condition for applying a driving pulse having a lower voltage and a longer application period compared to those provided under the present driving condition to the display section 6. That is, the pulse voltage applied to the display section 6 of the liquid crystal display element 1 can be lower in magnitude and longer in the application period compared to the driving pulse provided under the present driving condition, as the period is longer for which the present image has been displayed in the memorized state of display. Thus, the generation of an afterimage attributable to image sticking can be suppressed in the liquid crystal display element 1. When the present image has not been displayed in the memorized state of display for a period during which significant image sticking can presumably occur, the liquid crystal display element 1 continues using the present driving condition in displaying the new image on the display section 6. As a result, the time required for an image rewrite in the liquid crystal display element 1 can be kept short.

In the present embodiment, the liquid crystal display element 1 changes the driving condition D to the driving condition 1 when an image is rewritten based on the driving condition 2 at a rewrite frequency equal to or higher than once per period C1 for a period in the excess of the period B based on which it is considered that image sticking has been eliminated. Thus, the liquid crystal display element 1 can display a new image using the driving pulse having a higher voltage and a shorter application period when it is considered that image sticking at the display section 6 has been eliminated. In the liquid crystal display element 1, the generation of an afterimage attributable to image sticking can therefore be suppressed, and the time required for an image rewrite can be kept short when there is no need for the operation for preventing the generation of an afterimage as thus described.

The liquid crystal display element 1 of the present embodiment includes the three display portions 6*r*, 6*g*, and 6*b* having wavebands for selective reflection associated with red, green, and blue, respectively. When an image displayed in a memorized state of display by the display portions 6*r*, 6*g*, and 6*b* is rewritten into a new image, a driving condition for displaying the new image is selected depending on the period for which the present image has been displayed in the memorized state of display. As a result, even when the liquid crystal display element 1 has image sticking in the display section 6, it is possible to suppress a change in the ratio between reflections of red, green, and blue light rays attributable to the image sticking which disallows each of the display portions 6*r*, 6*g*, and 6*b* to display the image at a desired reflectance. Thus, the liquid crystal display element 1 can satisfactorily display a color image.

Figure 8:
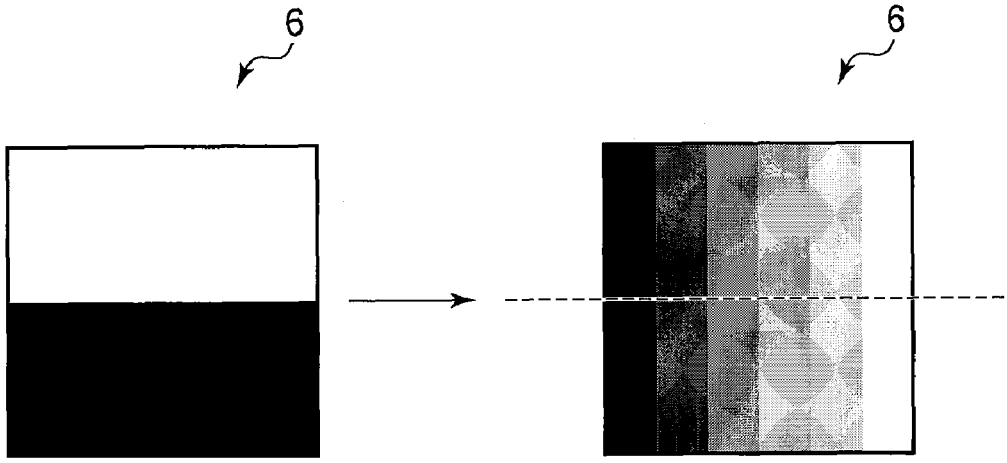
FIG. 8 is illustrations showing an example of a displayed image.

Examples of images displayed using the liquid crystal display element 1 of the present embodiment will now be described. FIG. 8 is illustrations showing an example of a displayed image.

Example 1

A display pattern as shown on the left side of FIG. 8 was displayed for seven days in a memorized state of display on the G display portion 6*g* of the display section 6, one half of the pattern representing the planar state in which green light is reflected to display green, the other half of the pattern representing the focal conic state in which black is displayed. Thereafter, a reset voltage of 36 V was applied, and a gradation pattern was displayed on the display section 6 as shown on the right side of FIG. 8 using a driving pulse with the voltage thereof kept at 10 V and the application period thereof varied in the range from 10 ms to 200 ms. As a result, the image was satisfactorily displayed without an afterimage attributable to image sticking.

Next, the display section 6 was driven for seven days to rewrite one displayed pattern into another every six hours. Thereafter, a reset voltage of 36 V was applied, and a gradation pattern was displayed on the display section 6 using a driving pulse with the voltage thereof kept at 20 V and the application period thereof varied in the range from 1 ms to 20 ms. As a result, as shown on the right side of FIG. 8, substantially the same brightness was obtained in the region where an image in green had been displayed in a memorized state of display (the region above the broken line) and the region where an image in black had been displayed in a memorized state of display (the region below the broken line), and the image was satisfactorily displayed without an afterimage attributable to image sticking.

Comparative Example 1

A display pattern as shown on the left side of FIG. 8 was displayed for seven days in a memorized state of display on the G display portion 6*g* of the display section 6, just as in Example 1. Thereafter, a reset voltage of 36 V was applied, and a gradation pattern was displayed on the display section 6 using a driving pulse with the voltage thereof kept at 20 V and the application period thereof varied in the range from 1 ms to 20 ms. As a result, the region below the broken line shown on the right side of FIG. 8 was relatively low in brightness compared to the region above the broken line, and the image which stuck to the display section 6 appeared as an afterimage. The afterimage was significantly visible especially where intermediate gray levels were displayed.

Example 2

A display pattern as shown on the left side of FIG. 8 was displayed for four days in a memorized state of display on the G display portion 6*g* of the display section 6, just as in Example 1. Thereafter, a reset voltage of 36 V was applied, and a gradation pattern was displayed on the display section 6 using a driving pulse with the voltage thereof kept at 15 V and the application period thereof varied in the range from 4 ms to 80 ms. As a result, the regions above and below the broken line shown on the right side of FIG. 8 were the same in brightness, and the image was satisfactorily displayed without an afterimage attributable to image sticking.

Subsequently, a display pattern was displayed on the G display portion 6*g* of the display section 6 for ten days in a memorized state of display, one half of the pattern representing the planar state in which green light is reflected to display green, the other half of the pattern representing the focal conic state in which black is displayed. Thereafter, a reset voltage of 36 V was applied, and a gradation pattern was displayed on the display section 6 using a driving pulse with the voltage thereof kept at 10 V and the application period thereof varied within the range from 10 ms to 200 ms. As a result, the regions above and below the broken line shown on the right side of FIG. 8 were the same in brightness, and the image was satisfactorily displayed without an afterimage attributable to image sticking.

Next, the display section 6 was driven for ten days to rewrite one displayed pattern into another every twelve hours. Thereafter, a reset voltage of 36 V was applied, and a gradation pattern was displayed on the display section 6 using a driving pulse with the voltage thereof kept at 15 V and the application period thereof varied in the range from 4 ms to 80 ms. As a result, the regions above and below the broken line shown on the right side of FIG. 8 were the same in brightness, and the image was satisfactorily displayed without an afterimage attributable to image sticking.

Subsequently, the display section 6 was driven for six days to rewrite a displayed pattern into another pattern every two hours. Thereafter, a reset voltage of 36 V was applied, and a gradation pattern was displayed on the display section 6 using a driving pulse with the voltage thereof kept at 20 V and the application period thereof varied in the range from 1 ms to 20 ms. As a result, the regions above and below the broken line shown on the right side of FIG. 8 were the same in brightness, and the image was satisfactorily displayed without an afterimage attributable to image sticking.

Comparative Example 2

A display pattern as shown on the left side of FIG. 8 was displayed for fourteen days in a memorized state of display on the G display portion 6*g* of the display section 6, just as in Example 1. Thereafter, a reset voltage of 36 V was applied, and a gradation pattern was displayed on the display section 6 using a driving pulse with the voltage thereof kept at 20 V and the application period thereof varied in the range from 1 ms to 20 ms. As a result, the region below the broken line shown on the right side of FIG. 8 was relatively low in brightness compared to the region above the broken line, and the image which stuck to the display section 6 appeared as an afterimage. The afterimage was significantly visible especially where intermediate gray levels were displayed.

Next, the display section 6 was driven for two days to rewrite one displayed pattern into another every twelve hours. Thereafter, a reset voltage of 36 V was applied, and a gradation pattern was displayed on the display section 6 using a driving pulse with the voltage thereof kept at 20 V and the application period thereof varied in the range from 1 ms to 20 ms. As a result, the region below the broken line shown on the right side of FIG. 8 was relatively low in brightness compared to the region above the broken line, and the image which stuck to the display section 6 appeared as an afterimage. The afterimage was significantly visible especially where intermediate gray levels were displayed.

While the G display portion 6*g* of the display section 6 was used in the above-described examples and comparative examples, similar results are obtained using the R display portion 6*r* and the B display portion 6*b*.

Second Embodiment

Figure 9:
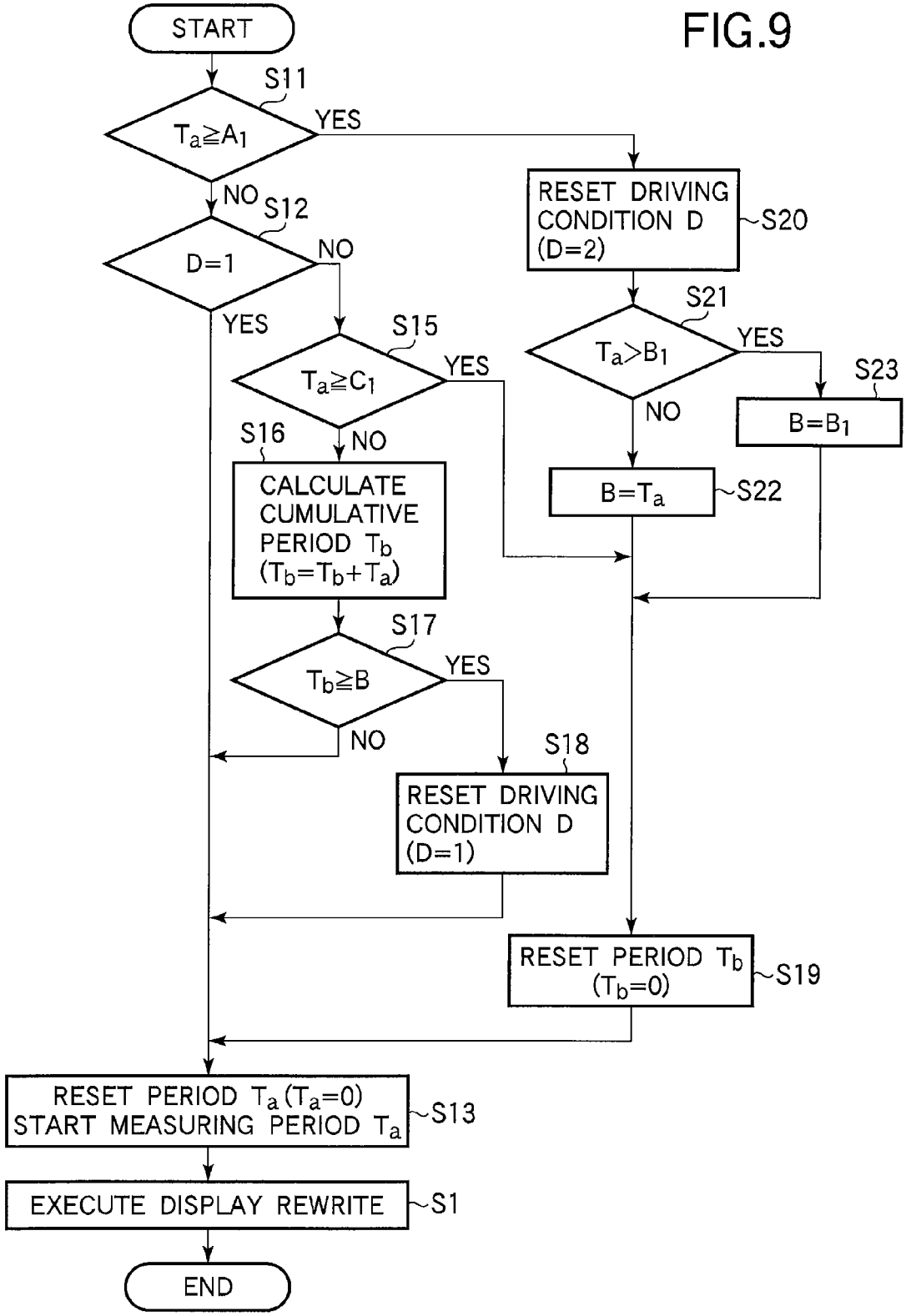
FIG. 9 is a flow chart for explaining processes and operations for driving a liquid crystal display element performed by a control section according to a second embodiment of the invention.

A liquid crystal display element according to a second embodiment of the invention will now be described with reference to FIG. 9. FIG. 9 is a flow chart for explaining processes and operations performed by a control section 30 to drive a display section 6.

The liquid crystal display element of the present embodiment has a configuration substantially the same as that of the liquid crystal display element 1 of the first embodiment. Driving condition data associated with driving conditions 1 and 2 similar to those in the first embodiment are stored in a driving condition storing portion 41 of the present embodiment. Hereinafter, parts identical between the embodiments are indicated by like reference numerals, and the description will omit such parts.

A period A1 is an image sticking determination period serving as a reference value used for determining the degree at which a displayed image sticks to the display section 6. In the present embodiment, for example, the duration of the period A1 is four days, and it is determined that an image has stuck to the display section 6 when the period A1 passes.

A period B is an image sticking elimination period serving as a reference value used for determining whether it can be considered that image sticking on the display section 6 has been eliminated or not. In the present embodiment, for example, the period B depends on the duration of an image sticking occurrence determination period Ta. The period B may have the same duration as that of the image sticking occurrence determination period Ta. Alternatively, a period B1 having a duration of, for example, ten days may be set as the period B.

A period C1 is a reference value used for determining a rewrite frequency. In the present embodiment, for example, the period C1 is one day.

Processes and operations performed by the control section 30 to drive the display section 6 will now be described. Steps S11 to S19 among the processes and operations in the present embodiment will not be described because they are similar to steps S1 to S9 of the first embodiment.

When it is determined at step S11 that the image sticking occurrence determination period Ta of an image being displayed in a memorized state of display is equal to or longer than the period A1 (the answer at step S11 is "Yes"), the control section 30 acquires the driving condition 2 from the driving condition storing portion 41 and resets the driving condition D to the driving condition 2 (D=2) (step S20).

When the driving condition D is reset to the driving condition 2, the control section 30 determines whether the image sticking occurrence determination period Ta is a period longer than the period B1 (step S21).

When it is determined that the image sticking occurrence determination period Ta is not a period longer than the period B1 (the answer at step S21 is "No"), the control section 30 sets the duration of the period B equal to that of the image sticking occurrence determination period Ta (step S22). When the period B is set equal in duration to the image sticking occurrence determination period Ta, the control section 30 executes the process at step S19.

When it is determined at step S21 that the image sticking occurrence determination period Ta is a period longer than the period B1 (the answer at step S21 is "Yes"), the control section 30 sets the period B1 as the period B (step S23). When the period B1 is set as the period B, the control section 30 executes the process at step S19.

When the image sticking occurrence determination period Ta is equal to or longer than the period A1, the control section 30 sets the driving condition 2 as the driving condition D at the above-described step, and a new image can be displayed based on the driving condition 2.

Let us assume that the image sticking occurrence determination period Ta is shorter than the period C1 and the image sticking elimination determination period Tb is equal to or longer than the period B while an image is displayed based on the driving condition 2. That is, the image is rewritten at a rewrite frequency equal to or higher than once per period C1 for a period which is equal to or longer than the period B. Then, the control section 30 sets the driving condition 1 as the driving condition D, and a new image can be displayed based on the driving condition 1.

At this time, when the duration of the image sticking occurrence determination period Ta has a value between the durations of the periods A1 and B1, inclusive, the control section 30 may set the period B1 as the period B. When the image sticking occurrence determination period Ta is longer than the period B1, the control section 30 may set the duration of the period B equal to that of the image sticking occurrence determination period Ta.

The present embodiment provides advantages similar to those of the first embodiment.

In the present embodiment, when the duration of the image sticking occurrence determination period Ta has a value between the durations of the periods A1 and B1, inclusive, the liquid crystal display element sets the period B1 as the period B. When the image sticking occurrence determination period Ta is longer than the period B1, the duration of the period B is set equal to that of the image sticking occurrence determination period Ta. Thus, in this liquid crystal display element, the duration of the period B, based on which it is considered that image sticking on the display section 6 has been eliminated, can be changed depending on the duration of the image sticking occurrence determination period Ta. Let us assume that the display section 6 has image sticking at an excessively high degree as a result of displaying the same image for a long time. Then, in this liquid crystal display element, it is possible to restrain a setting or change in the driving condition depending on the period for which the same image has been displayed so that a driving pulse having a higher voltage and a shorter application period compared to those of the present driving condition will be applied to the display section 6.

Third Embodiment

Figure 10:
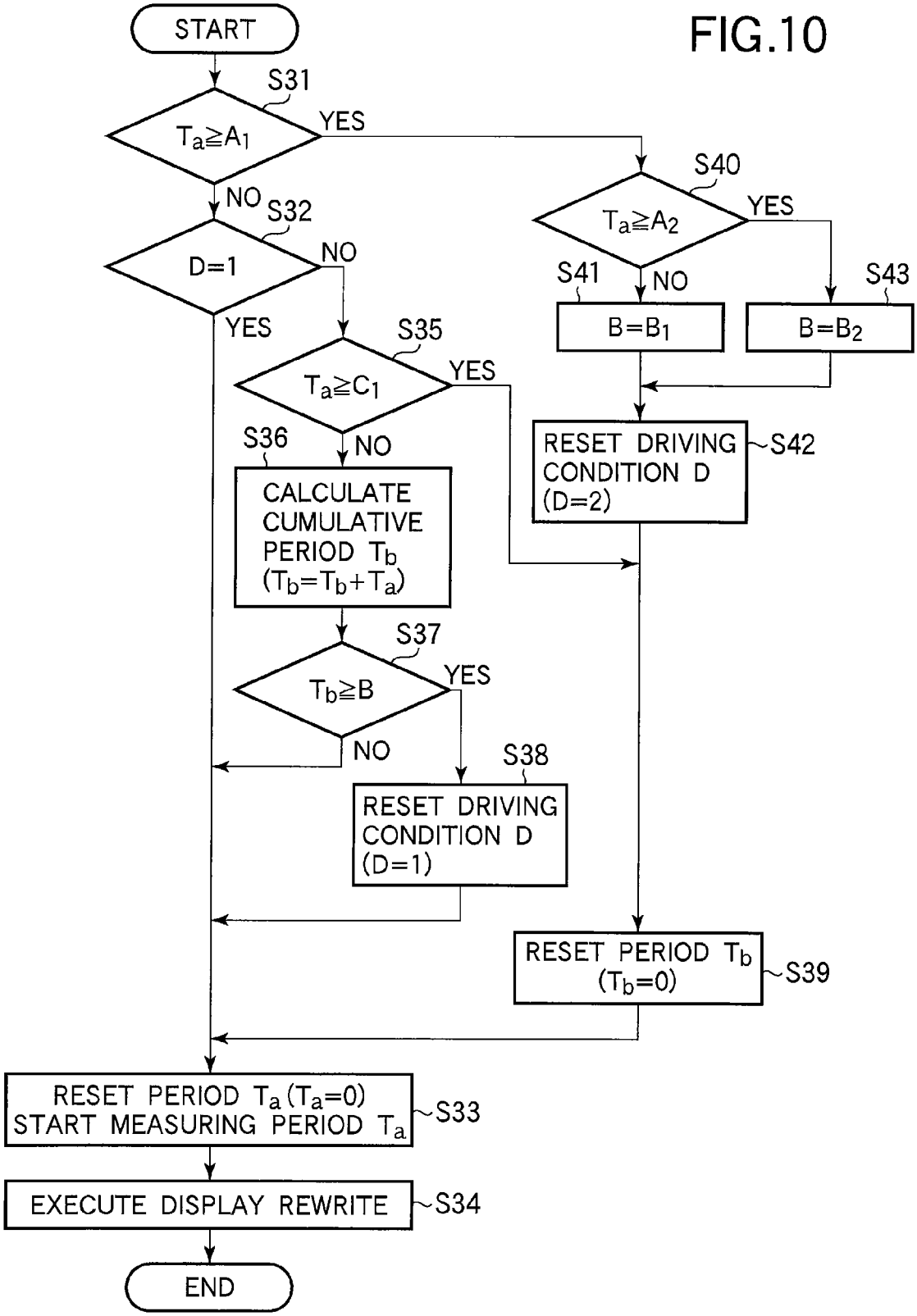
FIG. 10 is a flow chart for explaining processes and operations for driving a liquid crystal display element performed by a control section according to a third embodiment of the invention.

A liquid crystal display element according to a third embodiment of the invention will now be described with reference to FIG. 10. FIG. 10 is a flow chart for explaining processes and operations performed by a control section 30 to drive a display section 6.

The liquid crystal display element of the present embodiment has a configuration substantially the same as that of the liquid crystal display element 1 of the first embodiment. Driving condition data associated with driving conditions 1 and 2 similar to those in the first embodiment are stored in a driving condition storing portion 41 of the present embodiment. Hereinafter, parts identical between the embodiments are indicated by like reference numerals, and the description will omit such parts.

A period A1 and a period A2 are image sticking determination periods serving as reference values used for determining the degree at which a displayed image sticks to the display section 6. In the present embodiment, for example, the duration of the period A1 is four days, and the duration of the period A2 is eight days. The period A2 is associated with a higher degree of image sticking.

A period B is an image sticking elimination period serving as a reference value used for determining whether it can be considered that image sticking on the display section 6 has been eliminated or not. In the present embodiment, for example, a period B1 having a duration of seven days or a period B2 having a duration of fourteen days may be set as the period B depending on the duration of the image sticking occurrence determination period Ta.

A period C1 is a reference value used for determining a rewrite frequency. In the present embodiment, for example, the period C1 is one day.

Processes and operations performed by the control section 30 to drive the display section 6 will now be described. Steps S31 to S39 among the processes and operations in the present embodiment will not be described because they are similar to steps S1 to S9 of the first embodiment.

When it is determined at step S31 that the image sticking occurrence determination period Ta of an image being displayed in a memorized state of display is equal to or longer than the period A1 (the answer at step S31 is "Yes"), the control section determines whether the image sticking occurrence determination period Ta is equal to or longer than the period A2 (step S40).

When it is determined that the image sticking occurrence determination period Ta is not equal to or longer than the period A2 (the answer step S40 is "No"), the control section 30 sets the period B1 as the period B (step S41).

When the period B1 is set as the period B, the control section 30 acquires the driving condition 2 from the driving condition storing portion 41 to reset the driving condition D to the driving condition 2 (D=2) (step S42) and executes the process at step S39.

When it is determined at step S40 that the image sticking occurrence determination period Ta is equal to or longer than the period A2 (the answer at step S40 is "Yes"), the control section 30 sets the period B2 as the period B (step S43). When the period B2 is set as the period B, the control section 30 executes the process at step S42.

When the image sticking occurrence determination period Ta is equal to or longer than the period A1, the control section 30 sets the driving condition 2 as the driving condition D, and a new image can be displayed based on the driving condition 2.

Let us assume that the image sticking occurrence determination period Ta is equal to or shorter than the period C1 and the image sticking elimination determination period Tb is equal to or longer than the period B while an image is displayed based on the driving condition 2. That is, the image is rewritten at a rewrite frequency equal to or higher than once per period C1 for a period which is equal to or longer than the period B. Then, the control section 30 sets the driving condition 1 as the driving condition D, and a new image can be displayed based on the driving condition 1.

At this time, when the image sticking occurrence determination period Ta is equal to or longer than the period A1 and shorter than the period A2, the control section 30 may set the period B1 as the period B. When the image sticking occurrence determination period Ta is equal to or longer than the period A2, the control section 30 may set the period B2 as the period B.

The present embodiment provides advantages similar to those of the first embodiment.

In the present embodiment, in the liquid crystal display element, when the image sticking occurrence determination period Ta is equal to or longer than the period A1 and shorter than the period A2, the control section 30 sets the period B1 as the period B. When the image sticking occurrence determination period Ta is equal to or longer than the period A2, the period B2 is set as the period B based on which it is considered that image sticking has been eliminated. Thus, in this liquid crystal display element, the duration of the period B, based on which it is considered that image sticking on the display section 6 has been eliminated, can be changed depending on the duration of the image sticking occurrence determination period Ta. In this liquid crystal display element, depending on the degree of image sticking as a result of displaying the same image on the display section 6 for a long time, it is possible to restrain a setting or change in the driving condition so that a driving pulse having a higher voltage and a shorter application period compared to those of the present driving condition will be applied to the display section 6.

Fourth Embodiment

Figure 11:
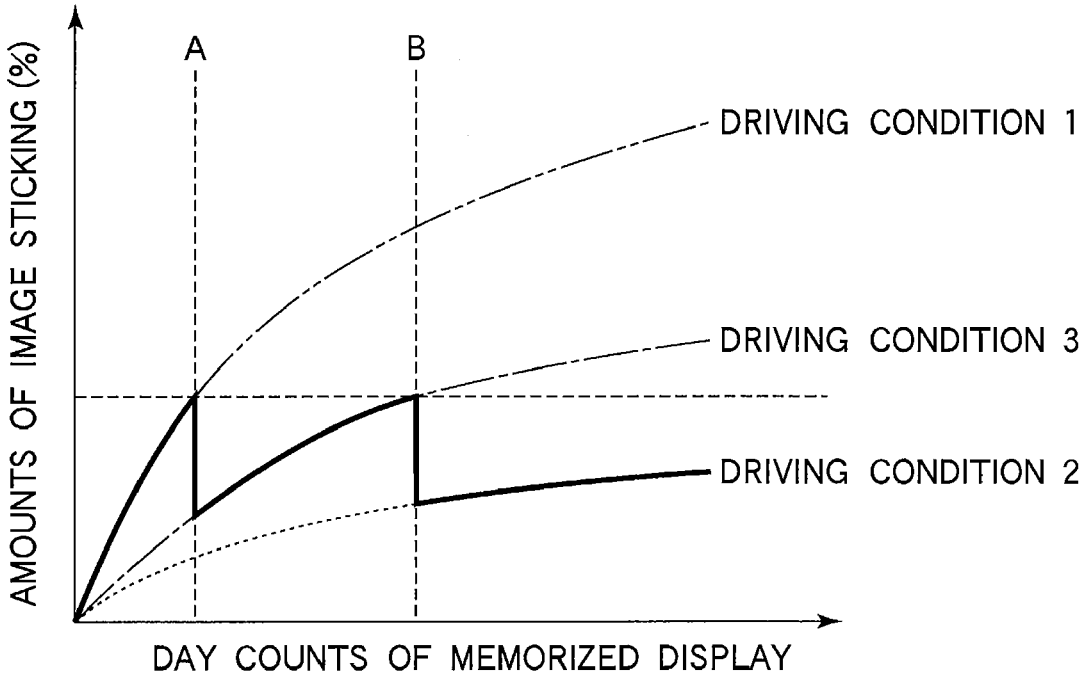
FIG. 11 is a conceptual diagram representing a method of driving a liquid crystal display element according to a fourth embodiment of the invention.
Figure 14A:
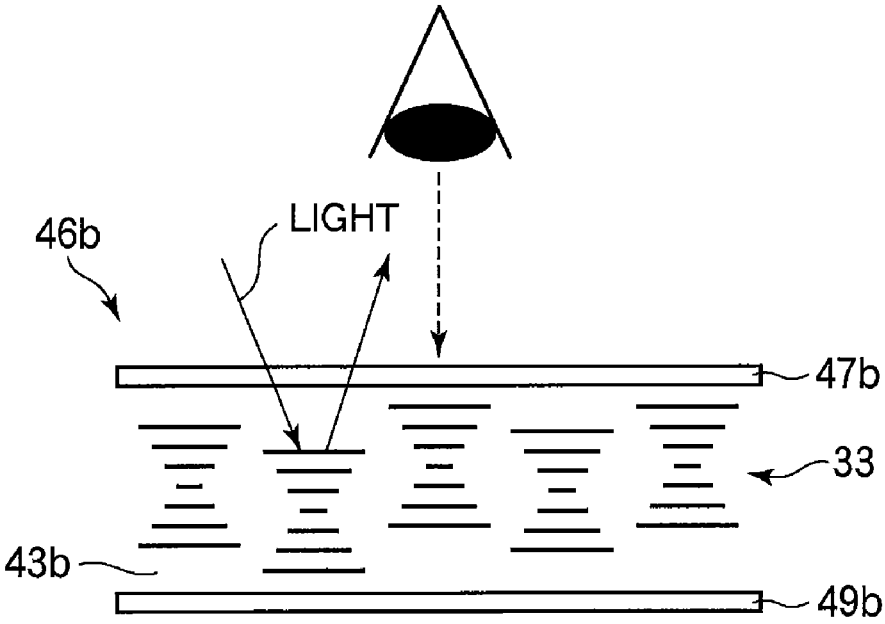
FIG. 14A is an illustration showing alignment of liquid crystal molecules of a cholesteric liquid crystal in a B liquid crystal layer of a B display portion observed when the layer is in the planar state.
Figure 14B:
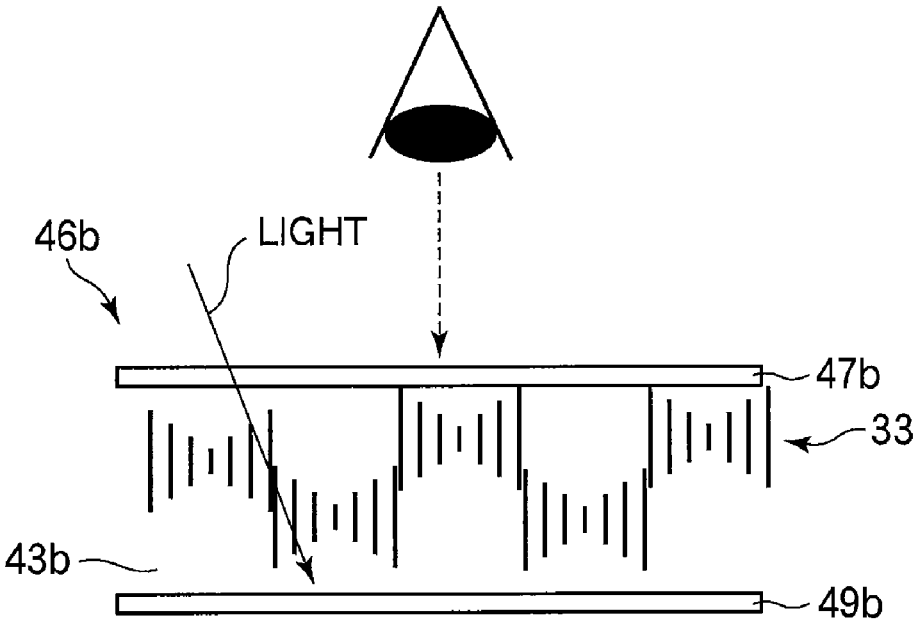
FIG. 14B is an illustration showing alignment of the liquid crystal molecules of the cholesteric liquid crystal in the B liquid crystal layer of the B display portion observed when the layer is in the focal conic state.
Figure 15:
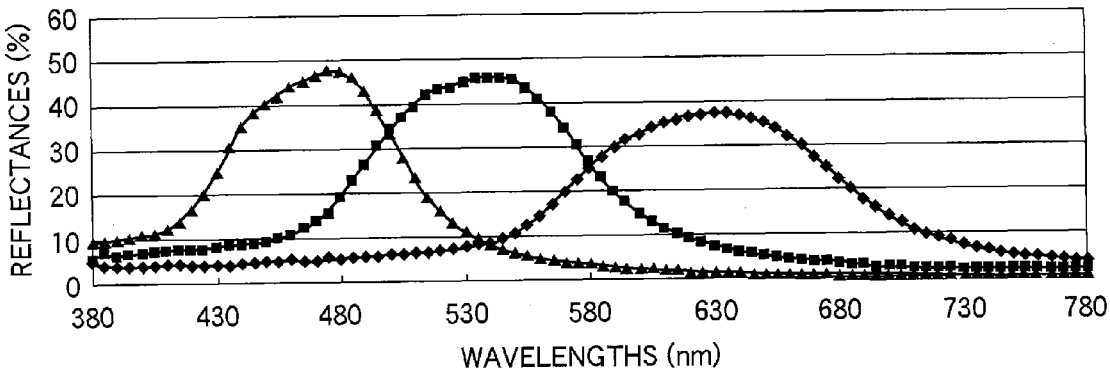
FIG. 15 is a graph showing examples of reflectance spectra observed at various liquid crystal layers in the planar state.

A liquid crystal display element according to a fourth embodiment of the invention will now be described with reference to FIGS. 11 and 12. FIG. 11 is a conceptual diagram representing a method of driving a liquid crystal display element according to the present embodiment. In FIG. 11, the horizontal axis represents counts of consecutive days on which an image is displayed in a memorized state of display before the image is rewritten, and the vertical axis represents amounts of image sticking (%) to which the definition given for the first embodiment applies.

The liquid crystal display element has a configuration substantially the same as that of the liquid crystal display element 1 of the first embodiment. Driving condition data associated with a driving condition 3 for applying a voltage of 15 V for an application period of 4 ms to 80 ms are stored in a driving condition storing section 41 of the present embodiment in addition to driving conditions 1 and 2 similar to those in the first embodiment. A driving pulse according to the driving condition 3 is set at a lower voltage and a longer application period compared to a driving pulse according to the driving condition 1, and the voltage and the application period are set higher and shorter, respectively than those of a driving pulse according to the driving condition 2. In the present embodiment, a voltage application time according to the driving condition 3 is set, for example, four times longer than an application time according to the driving condition 1 when the same gray level is to be obtained under those conditions. For example, the same gray level can be displayed when a voltage of 20 V is applied to the display section 6 for an application period of 1 ms and when a voltage of 15 V is applied to the display section 6 for an application period of 4 ms.

In the liquid crystal display element of the present embodiment, as shown in FIG. 11, the display section 6 is controlled according to three driving conditions. Thus, each time a new image is displayed by the liquid crystal display element, the driving condition can be changed to set a voltage and an application time one step lower and longer than the current setting to suppress an afterimage generated as a result of image sticking below a certain level when the new image is displayed. Hereinafter, parts identical between the present embodiment and the above-described embodiments are indicated by like reference numerals, and the description will omit such parts.

FIG. 12 is a flow chart for explaining processes and operations performed by a control section 30 to drive the display section 6.

Periods A1, A2, and A3 are image sticking determination periods serving as reference values used for determining the degree at which a displayed image sticks to the display section 6. In the present embodiment, for example, the duration of the period A1 is three days; the duration of the period A2 is seven days; and the duration of the period A3 is fourteen days. That is, the periods A1, A2, and A3 are associated with degrees of image sticking which ascends in the order in which the periods are listed.

A period B is an image sticking elimination period serving as a reference value used for determining whether it can be considered that image sticking on the display section 6 has been eliminated or not. In the present embodiment, the period B has the same duration as that of an image sticking occurrence determination period Ta.

A period C1 is a reference value used for determining a rewrite frequency. In the present embodiment, for example, the period C1 is one day.

Processes and operations performed by the control section 30 to drive the display section 6 will now be described. Steps S51 to S59 among the processes and operations in the present embodiment will not be described because they are similar to steps S1 to S9 of the first embodiment.

When it is determined at step S51 that the image sticking occurrence determination period Ta of an image being displayed in a memorized state of display is equal to or longer than the period A1 (the answer at step S51 is "Yes"), the control section determines whether the image sticking occurrence determination period Ta is equal to or longer than the period A2 (step S60).

When it is determined that the image sticking occurrence determination period Ta is not equal to or longer than the period A2 (the answer step S60 is "No"), the control section 30 acquires the driving condition 3 from the driving condition storing portion 41 and resets the driving condition D to the driving condition 3 (D=3) (step S61).

When the driving condition D is reset to the driving condition 3, the control section 30 sets the duration of the period B equal to that of the image sticking occurrence determination period Ta (step S62).

When it is determined at step S60 that the image sticking occurrence determination period Ta is equal to or longer than the period A2 (the answer at step S60 is "Yes"), the control section 30 determines whether the image sticking occurrence determination period Ta is equal to or longer than the period A3 (step S63).

When it is determined that the image sticking occurrence determination period Ta is not equal to or longer than the period A3 (the answer at step S63 is "No"), the control section 30 acquires the driving condition 2 from the driving condition storing portion 41, resets the driving condition D to the driving condition 2 (D=2) (step S64), and executes the process at step S62.

When it is determined at step S63 that the image sticking occurrence determination period Ta is equal to or longer than the period A3 (the answer at step S63 is "Yes"), the control section 30 sets the period A3 as the image sticking occurrence determination period Ta (step S65) and executes the process at step S64.

When the image sticking occurrence determination period Ta is equal to or longer than the period A2, the control section 30 sets the driving condition 2 as the driving condition D at the above-described step, and a new image can be displayed based on the driving condition 2. When the image sticking occurrence determination period Ta is equal to or longer than the period A1 and shorter than the period A2, the control section 30 sets the driving condition 3 as the driving condition D, and a new image can be displayed based on the driving condition 3.

Let us assume that the image sticking occurrence determination period Ta is equal to or shorter than the period C1 and the image sticking elimination determination period Tb is equal to or longer than the period B while an image is displayed based on the driving condition 2 or 3. In other words, let us assume that it is determined that the image has been rewritten at a rewrite frequency equal to or higher than once per period C1 for a period which is equal to or longer than the period B. Then, the control section 30 sets the driving condition 1 as the driving condition D, and a new image can be displayed based on the driving condition 1.

At this time, when the image sticking occurrence determination period Ta is equal to or longer than the period A1 and shorter than the period A3, the control section 30 may set the duration of the period B equal to that of the image sticking occurrence determination period Ta or equal to the duration of the display period for which the present image has been displayed. When the image sticking occurrence determination period Ta is equal to or longer than the period A3, the control section 30 may set the period A3, which is stored in advance in the driving condition storing portion 41, as the period B.

The present embodiment provides advantages similar to those of the first embodiment.

In the liquid crystal display element of the present embodiment, the driving condition D can be changed to a driving condition selected from among a plurality of driving conditions. In this liquid crystal display element, a voltage and a voltage application period can be adjusted more finely compared to the first embodiment in which only one driving condition can be selected to change the driving condition D. Therefore, the present embodiment allows the time required for an image rewrite to be made shorter than that in the case in which only one driving condition can be selected to change the driving condition D, while suppressing the generation of an afterimage attributable to image sticking.

Let us assume that the image sticking occurrence determination period Ta is equal to or longer than the period A1 and shorter than the period A2 and that the image sticking occurrence determination period Ta is equal to or longer than the period A2 and shorter than the period A3. Then, in the liquid crystal display element of the present embodiment, the duration of the period B, based on which it is considered that image sticking has been eliminated, is set equal to the duration of the image sticking occurrence determination period Ta. When the image sticking occurrence determination period Ta is equal to or longer than the period A3, in this liquid crystal display element, the period A3 is set as the period B based on which it is considered that image sticking has been eliminated. As thus described, in this liquid crystal display element, the duration of the period B, based on which it is considered that image sticking on the display section 6 has been eliminated, can be minutely set depending on the duration of the image sticking occurrence determination period Ta. In this liquid crystal display element, when image sticking occurs as a result of displaying the same image on the display section 6 for a long time, it is possible to adjust a change made to the present driving condition to apply a driving pulse having a higher voltage and a shorter application than those of the present driving condition according to the degree of the image sticking. Thus, the liquid crystal display element can perform an image rewrite in a short time while suppressing the generation of an afterimage attributable to image sticking appropriately.

Fifth Embodiment

A liquid crystal display element according to a fifth embodiment of the invention will now be described with reference to FIG. 13. FIG. 13 is a flow chart for explaining processes and operations performed by a control section 30 to drive a display section 6.

The liquid crystal display element of the present embodiment has substantially the same configuration as that of the liquid crystal display element 1 of the fourth embodiment. Driving condition data associated with driving conditions 1, 2 and 3 similar to those in the fourth embodiment are stored in a driving condition storing portion 41 of the present embodiment. Hereinafter, parts identical between the embodiments are indicated by like reference numerals, and the description will omit such parts.

A period A1 and a period A2 are image sticking determination periods serving as reference values used for determining the degree at which a displayed image sticks to the display section 6. In the present embodiment, for example, the duration of the period A1 is three days, and the duration of the period A2 is seven days. The period A2 is associated with a higher degree of image sticking.

A period B is an image sticking elimination period serving as a reference value used for determining whether it can be considered that image sticking on the display section 6 has been eliminated or not. The period B in the present embodiment is set at a period B1 which is, for example, six days or a period B2 which is, for example, ten days, depending on an image sticking occurrence determination period Ta.

A period C1 is a reference value used for determining a rewrite frequency. In the present embodiment, for example, the duration of the period C1 is one day.

Processes and operations performed by the control section 30 to drive the display section 6 will now be described. Steps S71 to S77 among the processes and operations in the present embodiment will not be described because they are similar to steps S1 to S7 in the first embodiment.

When it is determined at step S77 that an image sticking elimination determination period Tb is equal to or longer than the period B (the answer at step S77 is "Yes"), the control section 30 determines whether the driving condition D is the driving condition 3 (D=3) (step S78).

When it is determined that the driving condition D is the driving condition 3 (the answer at step S78 is "Yes"), the control section 30 acquires the driving condition 1 from the driving condition storing portion 41 to reset the driving condition D to the driving condition 1 (D=1) (step S79) and executes the process at step S73.

When it is determined at step S78 that the driving condition D is not the driving condition 3 (the answer at step S78 is "No"), the control section 30 acquires the driving condition 3 from the driving condition storing portion 41 to reset the driving condition D to the driving condition 3 (D=3) (step S80).

When the driving condition D is reset to the driving condition 3, the control section 30 sets a period B3 as the period B (step S81).

When the period B3 is set as the period B, the control section 30 resets the image sticking elimination determination period Tb to 0 (zero) and starts measuring the image sticking elimination determination period Tb (step S82). When the measurement of the image sticking elimination determination period Tb is started after resetting it, the control section 30 executes the process at step S73.

When it is determined at step S75 that the image sticking occurrence determination period Ta is equal to or longer than the period C1 (the answer at step S75 is "Yes"), the control section 30 executes the process at step S82.

When it is determined at step S71 that the image sticking occurrence determination period Ta of an image presently displayed in a memorized state of display is equal to or longer than the period A1 (the answer at step S71 is "Yes"), the control section 30 determines whether the image sticking occurrence determination period Ta is equal to or longer than the period A2 (step S83).

When it is determined that the image sticking occurrence determination period Ta is not equal to or longer than the period A2 (the answer at step S83 is "No"), the control section 30 determines whether the driving condition D is the driving condition 1 (D=1) (step S84).

When it is determined that the driving condition D is the driving condition 1 (the answer at step S84 is "Yes"), the control section 30 executes the process at step S80.

When it is determined at step S83 that the image sticking occurrence determination period Ta is equal to or longer than the period A2 (the answer at step S83 is "Yes") or when it is determined at step S84 that the driving condition D is not the driving condition 1 (the answer at step S84 is "No"), the control section 30 acquires the driving condition 2 from the driving condition storing portion 41 to reset the driving condition D to the driving condition 2 (D=2) (step S85).

When the driving condition D is reset to the driving condition 2, the control section 30 sets the period B2 as the period B (step S86) and executes the process at step S82.

The control section 30 may set the driving condition 2 as the driving condition D at the above-described step to display a new image based on the driving condition 2 (I) when the image sticking occurrence determination period Ta is equal to or longer than the period A2 or (II) when the image sticking occurrence determination period Ta is equal to or longer than the period A1 and shorter than the period A2 with a driving condition other than the driving condition 1 set as the driving condition D.

The control section 30 may set the driving condition 3 as the driving condition D to display a new image based on the driving condition 3 (I) when the image sticking occurrence determination period Ta is equal to or longer than the period A1 and shorter than the period A2 with the driving condition 1 set as the present driving condition D or (II) when the image sticking occurrence determination period Ta is shorter than the period C1 and the image sticking elimination determination period Tb is equal to or longer than the period B while an image is being displayed based on the driving condition 2.

When the driving condition 3 is set as the driving condition D, the control section 30 may set the period B3 as the period B. When the driving condition 2 is set as the driving condition D, the control section 30 may set the period B2 as the period B.

When the image sticking occurrence determination period Ta is shorter than the period C1 and the image sticking elimination determination period Tb is equal to or longer than the period B while an image is being displayed based on the driving condition 3, the control section 30 may set the driving condition 1 as the driving condition D to display a new image based on the driving condition 1.

Let us assume that a change is made on the present driving condition D to apply a higher voltage for a shorter application period. Then, the control section 30 can make such a change to apply to the driving condition 1 only when the present driving condition D is the driving condition 3. That is, the control section 30 can acquire driving conditions D to replace the driving condition D applied to the presently displayed image in the order of the closeness of the alternative driving conditions D to the present driving condition D in terms of characteristics such that the magnitude and application period of the applied voltage will change gradually.

The present embodiment provides advantages similar to those of the fourth embodiment.

Referring to changes made to the presently applied driving condition D to apply a higher voltage for a shorter application period, in the liquid crystal display element of the present embodiment, a change to the driving condition 1 can be made only when the present driving condition D is the driving condition 3. As thus described, in this liquid crystal display element, no abrupt change to the driving condition for applying the highest voltage for the shortest application period takes place, and the magnitude and application period of the voltage applied to element can therefore be gradually changed. As a result, in this liquid crystal display element, the time required for an image rewrite can be kept short while suppressing the generation of an afterimage attributable to image sticking appropriately.

While the invention has been described above based on embodiments thereof, the invention is not limited to the above-described embodiments and may be modified in various ways.

In the above-described embodiments, whether to change one driving condition to another is determined based on a period during which image rewriting has been performed at a frequency of once per day or higher. However, the invention is not limited to such a criterion, and the determination may be made based on a rewrite frequency of twice per day or higher.

While two or three types of driving conditions are used in the above-described embodiments, the invention is not limited to such driving conditions. A plurality of intermediate driving conditions may be provided, for example, between the driving conditions 1 and 3 and between the driving conditions 2 and 3. For example, the fourth embodiment may include a driving condition 4 that is intermediate between the driving conditions 1 and 3, which allows a driving pulse to be applied to the display section 6 at a voltage lower than the driving condition 1 and higher than the driving condition 3 for an application period longer than the driving condition 1 and shorter than the driving condition 3.

Further, while the above embodiments have been described as using the line sequential driving (line sequential scan) method by way of example, the invention is not limited to such a driving method, and the dot sequential driving method may alternatively be used.

While the above embodiments have been described as liquid crystal display elements having a three-layer structure formed by stacking display portions 6*b*, 6*g*, and 6*r* by way of example, the invention is not limited to such elements and may be applied to liquid crystal display elements having a structure formed by one layer, two layers, or four or more layers.

In the above-described embodiments, the display portions 6*b*, 6*g*, and 6*r* are driven according to a passive driving method using electrodes in the form of a matrix. The invention is not limited to such a method, and it is compatible with the use of an active driving method utilizing TFTs (thin film transistors), an optical writing method utilizing a photoconductive layer and the like.

The above embodiments have been described as having a configuration for varying driving conditions of driving pulses associated with all pixels formed at the display section 6 by way of example. The invention is not limited to such a configuration, and only driving conditions of driving pulses associated with part or all of pixels displaying intermediate gray levels may be varied.

According to the invention, even when image sticking occurs, the generation of an afterimage attributable to the image sticking can be suppressed. The invention can therefore be applied various types of liquid crystal display elements.

What is claimed is:

1. A liquid crystal display element comprising:

a display section having memory characteristics including a cholesteric liquid crystal layer and displaying an image when a voltage is applied to the cholesteric liquid crystal layer, the section being capable of keeping the image displayed without electric power;

a driving condition storing section for storing a plurality of different driving conditions including a voltage and an application period of the voltage; and a control section determining a display period for which a presently displayed image has been displayed on the display section having memory characteristics when the displayed image is rewritten into a new image, acquiring a driving condition according to the display period from the driving condition storing section, and causing the display section having memory characteristics to display the new image based on the acquired driving condition.

2. The liquid crystal display element according to claim 1, wherein the driving condition according to the display period includes a lower voltage and a longer application period, as the display period is longer.

3. The liquid crystal display element according to claim 1, wherein the driving condition according to the display period includes a lower voltage and a longer application period compared to those of the driving condition for the presently displayed image when the display period has exceeded an image sticking occurring period based on which the displayed image is regarded as having stuck to the display section having memory characteristics.

4. The liquid crystal display element according to claim 1, wherein the driving condition according to the display period is the same driving condition as the driving condition for the presently displayed image.

5. The liquid crystal display element according to claim 1, wherein when the presently displayed image is rewritten into the new image, the control section determines whether the period of an image rewrite performed at a rewrite frequency equal to or higher than a predetermined rewrite frequency has exceeded an image sticking elimination period based on which image sticking on the display section having memory characteristics is regarded as having been eliminated, the control section acquiring a driving condition including a higher voltage and a shorter application period compared to those of the driving condition for the presently displayed image from the driving condition storing section when the image sticking elimination period has been exceeded.

6. The liquid crystal display element according to claim 5, wherein the image sticking elimination period varies depending on the display period.

7. The liquid crystal display element according to claim 5, wherein the image sticking elimination period has the same duration as that of the display period.

8. The liquid crystal display element according to claim 1, wherein the control section acquires driving conditions in the order of their closeness to the driving condition for the presently displayed image in terms of characteristics such that the voltage and the application period are gradually changed.

9. The liquid crystal display element according to claim 1, wherein the control section changes the application period by controlling the scan speed of a scan electrode driving the cholesteric liquid crystal layer.

10. The liquid crystal display element according to claim 1, wherein the display section having memory characteristics includes three cholesteric liquid crystal layers having selective reflection wavebands associated with red, green, and blue, respectively.

11. A method of driving a liquid crystal display element, comprising the steps of:

determining a display period for which a presently displayed image has been displayed on a display section having memory characteristics when the displayed image is rewritten into a new image, the display section including a cholesteric liquid crystal layer and displaying an image when a voltage is applied to the cholesteric liquid crystal layer, the section being capable of keeping the image displayed without electric power;

acquiring a driving condition according to the display period from a driving condition storing section; and causing the display section having memory characteristics to display the new image based on the acquired driving condition.

12. The method according to claim 11, wherein the driving condition according to the display period includes a lower voltage and a longer application period, as the display period is longer.

13. The method according to claim 11, wherein the driving condition according to the display period includes a lower voltage and a longer application period compared to the driving condition for the presently displayed image when the display period has exceeded an image sticking occurring period based on which the displayed image is regarded as having stuck to the display section having memory characteristics.

14. The method according to claim 11, wherein the driving condition according to the display period is the same driving condition as the driving condition for the presently displayed image.

15. The method according to claim 11, wherein:

when the presently displayed image is rewritten into the new image, it is determined whether the period of an image rewrite performed at a rewrite frequency equal to or higher than a predetermined rewrite frequency has exceeded an image sticking elimination period based on which image sticking on the display section having memory characteristics is regarded as having been eliminated; and a driving condition including higher voltage and a shorter application period compared to the driving condition for the presently displayed image is acquired from the driving condition storing section when the image sticking elimination period has been exceeded.

16. The method according to claim 15, wherein the image sticking elimination period varies depending on the display period.

17. The method according to claim 15, wherein the image sticking elimination period has the same duration as that of the display period.

18. The method according to claim 11, comprising the step of acquiring driving conditions in the order of their closeness to the driving condition for the presently displayed image in terms of characteristics such that the voltage and the application period are gradually changed.

19. The method according to claim 11, comprising the step of changing the application period by controlling the scan speed of a scan electrode driving the cholesteric liquid crystal layer.

* * * * *